US011679310B1

(12) United States Patent
Evans et al.

(10) Patent No.: US 11,679,310 B1
(45) Date of Patent: Jun. 20, 2023

(54) SYSTEMS AND METHODS FOR A WEIGHTED GOLF CLUB HEAD

(71) Applicant: Cobra Golf Incorporated, Carlsbad, CA (US)

(72) Inventors: D. Clayton Evans, San Marcos, CA (US); Ryan L. Roach, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 17/237,627

(22) Filed: Apr. 22, 2021

Related U.S. Application Data

(63) Continuation of application No. 16/809,352, filed on Mar. 4, 2020, now Pat. No. 11,033,782.

(51) Int. Cl.
*A63B 53/04* (2015.01)
*A63B 60/02* (2015.01)
*A63B 102/32* (2015.01)

(52) U.S. Cl.
CPC ..... *A63B 53/04* (2013.01); *A63B 60/02* (2015.10); *A63B 53/0433* (2020.08); *A63B 2053/0491* (2013.01); *A63B 2102/32* (2015.10)

(58) Field of Classification Search
CPC ..... A63B 53/04; A63B 53/0466; A63B 2053/0491; A63B 2102/32; A63B 60/02; A63B 60/04
USPC ..... 473/324, 332, 334, 335, 338
See application file for complete search history.

(56) References Cited

U.S. PATENT DOCUMENTS

| | | | | |
|---|---|---|---|---|
| 6,254,494 | B1 * | 7/2001 | Hasebe | A63B 53/04 473/345 |
| 6,945,877 | B2 * | 9/2005 | Kobayashi | A63B 60/02 473/345 |
| 7,775,905 | B2 | 8/2010 | Beach et al. | |
| 8,016,694 | B2 | 9/2011 | Llewellyn et al. | |
| 8,033,931 | B2 | 10/2011 | Wahl et al. | |
| 8,083,611 | B2 | 12/2011 | Kuan et al. | |
| 8,221,263 | B2 | 7/2012 | Tavares et al. | |
| 8,371,957 | B2 | 2/2013 | Schweigert et al. | |
| 8,425,346 | B1 | 4/2013 | Erickson | |

(Continued)

FOREIGN PATENT DOCUMENTS

| | | |
|---|---|---|
| EP | 2445596 B1 | 3/2015 |
| EP | 2485814 B1 | 5/2016 |

(Continued)

*Primary Examiner* — John E Simms, Jr.
(74) *Attorney, Agent, or Firm* — Quarles & Brady LLP

(57) ABSTRACT

A golf club head includes a body defining an exterior surface having a forward-most point and a rearward-most point that define a horizontal club head length therebetween that extends parallel to a ground plane. The body includes a face, a sole, and a crown. A front weight assembly having a first weight is secured with at least one fastener and defines a first center of gravity, and a rear weight assembly having a second weight is coupled with the body and defines a second center of gravity. A sole gap formed between an underside of the first weight and the sole defines a height of between 0.5 millimeters and 6 millimeters, the first center of gravity and the second center of gravity define a horizontal weight system length, and a ratio between the horizontal weight system length and the horizontal club head length is between 80% and 99%.

20 Claims, 25 Drawing Sheets

(56) References Cited

U.S. PATENT DOCUMENTS

| | | | | |
|---|---|---|---|---|
| 8,435,136 | B2 | 5/2013 | Stites et al. | |
| 8,641,556 | B2 | 2/2014 | Kuan et al. | |
| 8,740,719 | B2 | 6/2014 | Wahl et al. | |
| 8,852,023 | B2 | 10/2014 | Stites et al. | |
| 8,900,070 | B1 | 12/2014 | Dawson et al. | |
| 8,926,448 | B1 | 1/2015 | Ivanova et al. | |
| 9,199,145 | B1 | 12/2015 | Myers | |
| 9,211,451 | B1 | 12/2015 | Westrum et al. | |
| 9,233,282 | B2 | 1/2016 | Stites et al. | |
| 9,586,105 | B1 | 3/2017 | Westrum et al. | |
| 9,675,856 | B1 | 6/2017 | Gibbs et al. | |
| 9,782,642 | B1 * | 10/2017 | DeMille | A63B 60/42 |
| 9,914,028 | B1 | 3/2018 | Cleghorn et al. | |
| 10,004,958 | B2 | 6/2018 | Tang et al. | |
| 10,010,771 | B2 | 7/2018 | Seluga et al. | |
| 10,369,437 | B1 | 8/2019 | Cleghorn et al. | |
| 10,406,407 | B2 | 9/2019 | DeMille et al. | |
| 10,888,751 | B1 * | 1/2021 | Frederickson | A63B 60/04 |
| 2003/0232663 | A1 * | 12/2003 | Bliss | A63B 53/04 473/345 |
| 2006/0100032 | A1 | 5/2006 | Imamoto et al. | |
| 2006/0172821 | A1 | 8/2006 | Evans | |
| 2008/0019354 | A1 | 1/2008 | Wan | |
| 2008/0194354 | A1 | 8/2008 | Nagai et al. | |
| 2011/0053705 | A1 | 3/2011 | Stites | |
| 2012/0064991 | A1 | 3/2012 | Evans | |
| 2013/0165255 | A1 | 6/2013 | Bezilla et al. | |
| 2014/0113742 | A1 | 4/2014 | Zimmerman et al. | |
| 2015/0031472 | A1 * | 1/2015 | Stokke | A63B 60/00 473/338 |
| 2015/0065265 | A1 * | 3/2015 | Motokawa | A63B 53/04 473/335 |
| 2015/0360099 | A1 * | 12/2015 | Ban | A63B 53/06 473/324 |
| 2016/0059093 | A1 | 3/2016 | Nielson et al. | |
| 2016/0250525 | A1 * | 9/2016 | Motokawa | A63B 60/04 473/336 |
| 2017/0050091 | A1 * | 2/2017 | Shimahara | A63B 53/04 |
| 2017/0072277 | A1 | 3/2017 | Mata et al. | |
| 2017/0113105 | A1 | 4/2017 | Seluga et al. | |
| 2017/0151474 | A1 | 6/2017 | Seluga et al. | |
| 2017/0165539 | A1 | 6/2017 | Seluga et al. | |
| 2017/0182381 | A1 | 6/2017 | Seluga et al. | |
| 2018/0200590 | A1 | 7/2018 | Evans et al. | |
| 2018/0345093 | A1 | 12/2018 | Harbert et al. | |
| 2019/0201756 | A1 | 7/2019 | Seluga et al. | |
| 2019/0251934 | A1 | 8/2019 | Hashimoto et al. | |
| 2019/0290972 | A1 * | 9/2019 | Del Rosario | A63B 53/0466 |
| 2019/0314695 | A1 | 10/2019 | Taylor et al. | |
| 2020/0070023 | A1 | 3/2020 | Knight | |
| 2020/0197769 | A1 | 6/2020 | Stokke et al. | |
| 2020/0206586 | A1 * | 7/2020 | Yamamoto | A63B 53/0466 |
| 2020/0298072 | A1 * | 9/2020 | Morales | A63B 60/02 |
| 2021/0086039 | A1 * | 3/2021 | Aramaki | B23K 26/32 |

FOREIGN PATENT DOCUMENTS

| | | | |
|---|---|---|---|
| EP | 1784242 | B1 | 1/2017 |
| EP | 2316545 | B1 | 7/2017 |
| EP | 2482938 | B1 | 8/2017 |
| EP | 2504067 | B1 | 8/2018 |
| EP | 2421615 | B1 | 9/2018 |
| EP | 2240247 | B1 | 10/2018 |
| EP | 2451542 | B1 | 1/2019 |
| EP | 2414052 | B1 | 8/2019 |

* cited by examiner

SYSTEMS AND METHODS FOR A WEIGHTED GOLF CLUB HEAD

CROSS REFERENCE TO RELATED APPLICATIONS

This application is a continuation of U.S. patent application Ser. No. 16/809,352, filed on Mar. 4, 2020, and entitled SYSTEMS AND METHODS FOR A WEIGHTED GOLF CLUB HEAD, the entire contents of which is incorporated herein by reference in its entirety.

REFERENCE REGARDING FEDERALLY SPONSORED RESEARCH OR DEVELOPMENT

Not applicable

SEQUENCE LISTING

Not applicable

BACKGROUND

1. Field of the Disclosure

The present disclosure relates generally to golf clubs having weighted head systems, and more specifically, golf club heads having generally forward and rearward weight assemblies.

2. Description of the Background

Many golfers at all skill levels constantly seek to improve their performance and lower their golf scores. As a result, players are frequently in search for updated and improved equipment. The performance of a golf club can vary based on several factors, including weight distribution about the head. The weight distribution about the head generally affects the location of the center of gravity of the golf club head, as well as the mass moment of inertia. Distributing weight about the head can provide more forgiveness in a club head, improved accuracy, better spin control, and can optimize a golf ball trajectory.

Ordinarily, players who swing at higher head speeds tend to generate higher than desired ball backspin rates, which reduce the distance that the golf ball may travel on a particular shot. One method for reducing undesirable backspin is to use forward weighted designs. Unfortunately, when weight is added to the forward position, the club head's moment of inertia is reduced, thereby negatively impacting the distance and straightness of off-center hits. Additionally, forward weighted designs that place the weight too close to the face compromise the flexibility of the face, thereby increasing the stiffness and reducing the speed of a golf ball on a single shot. While it may be desirable to provide both forward and rearward weights in a single club head, an appropriate distance between each weight's respective center of gravity is required before the weighting system can favorably affect the quality of a shot.

Therefore, a mass system configured to provide a desired club center of gravity while reducing the rate of backspin of a ball may be desired.

SUMMARY

A weighting system for a golf club head, as described herein, may have various configurations. In some embodiments, a golf club head defines a head center of gravity, and the golf club head includes a body defining an interior cavity and an exterior surface having a forward-most point and a rearward-most point that define a horizontal club head length therebetween that extends parallel to a ground plane. The body includes a face disposed within a forward portion of the golf club head and extending between a toe and a heel, a sole defining a bottom portion of the golf club head, and a crown defining a top portion of the golf club head. The golf club head further includes a front weight assembly having a first weight secured with at least one fastener, the front weight assembly being disposed forward of the head center of gravity and between the toe and the heel, the front weight assembly defining a first center of gravity, and a rear weight assembly having a second weight that is coupled with the body, the rear weight assembly being disposed rearward of the head center of gravity, and defining a second center of gravity. A sole gap is formed between an underside of the first weight and the sole, the sole gap defining a height of between 0.5 millimeters and 6 millimeters. The first center of gravity and the second center of gravity define a horizontal weight system length therebetween that extends parallel to the ground plane. A ratio between the horizontal weight system length and the horizontal club head length is between 80% and 99%.

In some embodiments, the at least one fastener defines an axis that extends through the sole and the crown. In some embodiments, the first weight is secured with at least two fasteners that extend toward the sole. In some embodiments the at least two fasteners define axes that extend through the crown and the sole. In some embodiments, the second weight is disposed exterior to the body, and the first weight is disposed interior to the body. In some embodiments, the ratio between the horizontal weight system length and the horizontal club head length is between 85.8% and 99%. In some embodiments, a front weight aperture is provided forward of the head center of gravity, and the front weight aperture is configured to receive one of the at least one fasteners. In some embodiments, the front weight assembly further includes a sole mount that is dimensioned to be received in the front weight aperture, the sole mount being coupled to and disposed along an underside of the sole. In some embodiments, the sole mount is configured to be removable from the golf club head. In some embodiments, the second weight of the rear weight assembly is not secured using a fastener.

In some embodiments, a golf club head defines a head center of gravity and includes a body defining an interior cavity and an exterior surface having a forward-most point and a rearward-most point that define a horizontal club head length therebetween that extends parallel to a ground plane. The body includes a face disposed within a forward portion of the golf club head and extending between a toe and a heel, a sole defining a bottom portion of the golf club head, and a crown defining a top portion of the golf club head. The golf club head further includes a front weight assembly having a first weight, the front weight assembly being disposed forward of the head center of gravity and between the toe and the heel, the front weight assembly defining a first center of gravity, and a rear weight assembly having a second weight that is coupled with the body, the rear weight assembly being disposed rearward of the head center of gravity, and defining a second center of gravity. The first center of gravity and the second center of gravity define a horizontal weight system length therebetween that extends parallel to the ground plane, and a ratio between the horizontal weight system length and the horizontal club head length is between 85.5% and 99%.

In some embodiments, a sole gap is formed between an underside of the first weight and the sole, the sole gap defining a height of between 0.5 millimeters and 6 millimeters. In some embodiments, the first weight is secured with at least one fastener that extend toward the sole. In some embodiments, the ratio between the horizontal weight system length and the horizontal club head length is between 87.3% and 99%. In some embodiments, a front weight aperture is provided forward of the head center of gravity, the front weight aperture being configured to receive at least one fastener. In some embodiments, the front weight assembly further includes a sole mount that is dimensioned to be received in the front weight aperture, the sole mount being coupled to and disposed along an underside of the sole.

In some embodiments, a golf club head defining a head center of gravity includes a body comprising a face disposed within a forward portion of the golf club head and extending between a toe and a heel, a sole defining a bottom portion of the golf club head, and a crown defining a top portion of the golf club head. The golf club head further includes a front weight assembly having a first weight, the front weight assembly being disposed forward of the head center of gravity and between the toe and the heel, the front weight assembly defining a first center of gravity, and a rear weight assembly having a second weight that is coupled with the body, the rear weight assembly being disposed rearward of the head center of gravity, and defining a second center of gravity. The first center of gravity and the second center of gravity are separated by at least 69.9 millimeters, and a sole gap is formed between an underside of the first weight and the sole, the sole gap defining a height of between 1 millimeter and 6 millimeters.

In some embodiments, the front weight is secured with at least one fastener that defines an axis that extends through the sole and the crown. In some embodiments, a face gap is formed between a side of the first weight and the face, the face gap defining a width of between 1 millimeter and 4 millimeters. In some embodiments, at least one of the first weight assembly and the second weight assembly is adjustable.

In some embodiments, a golf club head defining a head center of gravity includes a body defining a rearward-most point. The body includes a face disposed within a forward portion of the golf club head and extending between a toe and a heel, a sole defining a bottom portion of the golf club head, and a crown defining a top portion of the golf club head. The golf club head further includes a front weight assembly having a first weight, the front weight assembly being disposed forward of the head center of gravity and between the toe and the heel, the front weight assembly defining a first center of gravity. The first center of gravity and the rearward-most point are separated by at least 69.9 millimeters, and a sole gap is formed between an underside of the first weight and the sole, the sole gap defining a height of between 1 millimeter and 6 millimeters.

In some embodiments, the first center of gravity and the rearward-most point are separated by at least 101.7 millimeters. In some embodiments, the first weight defines a first side and a second side opposite the first side, and the sole gap extends entirely between the first side and the second side of the first weight along the underside thereof.

DETAILED DESCRIPTION OF THE DRAWINGS

Figure 1:
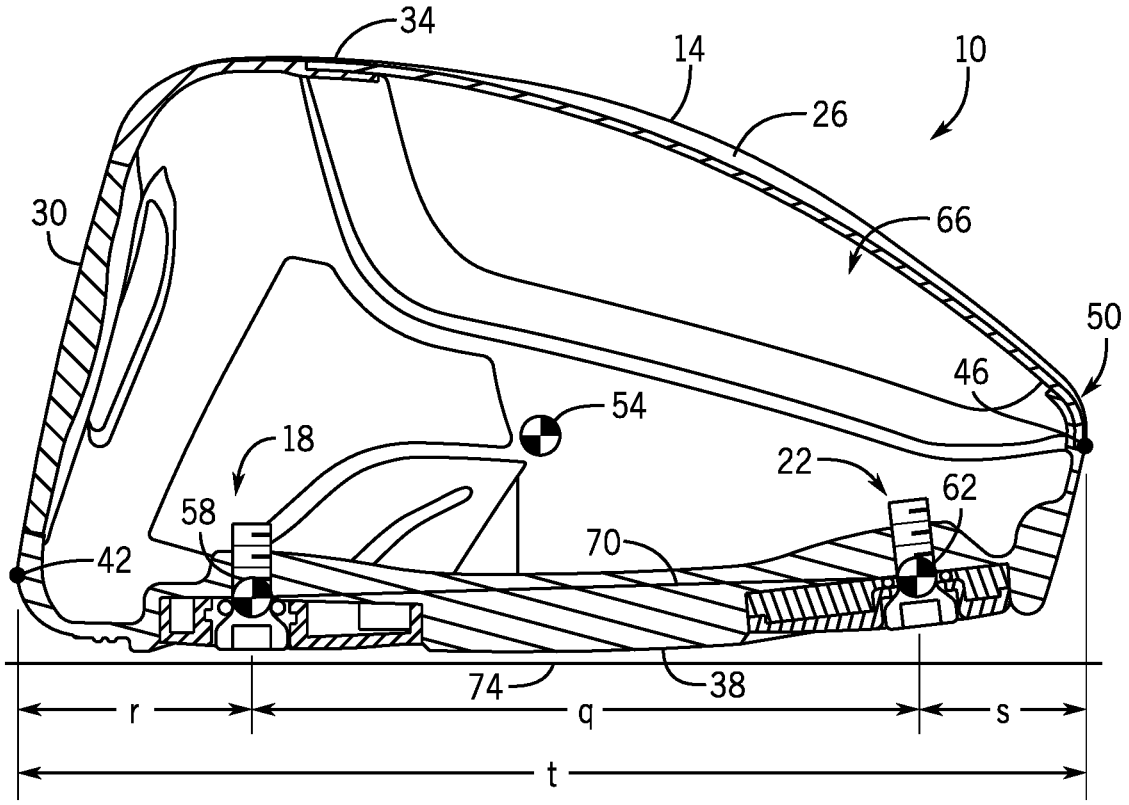
FIG. 1 PRIOR ART
FIG. 1 is a diagrammatic side view of a golf club head including an example of a relative distance between a front weight assembly and a rear weight assembly according to the prior art.

The following discussion and accompanying figures disclose various embodiments or configurations of a weighted system of a golf club head to alter the performance characteristics of the club head. More specifically, the following discussion provides a weighting system that allows for improved spin control by minimizing the flexibility of the face and simultaneously providing an appropriate mass moment of inertia.

A mass moment of inertia is a measure of a club head's resistance to twisting about the golf club head's center of gravity, for example, on impact with a golf ball. As generally understood, a moment of inertia of a mass about a given axis is proportional to the square of the distance of the mass away from the axis. In other words, increasing the distance of a mass from a given axis results in an increased moment of inertia of the mass about that axis. Accordingly, a higher moment of inertia results in a lower club head rotation on impact with a golf ball, particularly on "off-center" impacts with a golf ball (e.g., mis-hits). Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in a greater ball speed on impact with the golf club head, which can translate to an increased golf shot distance. As used herein, the terms "mass" and "weight" are used interchangeably, although it is understood that these terms refer to different properties in a strict physical sense.

The following discussion and accompanying figures disclose various embodiments or configurations of a golf club and a weighting system for a golf club head. Although embodiments are disclosed with reference to a wood-type golf club, such as a driver, concepts associated with embodiments of the wood-type golf club may be applied to a wide range of golf clubs. For example, embodiments disclosed herein may be applied to a number of golf clubs including hybrid clubs, iron-type golf clubs, utility-type golf clubs, and the like. The term "about," as used herein, refers to variation in the numerical quantity that may occur, for example, through typical measuring and manufacturing procedures used for articles of manufacture that may include embodiments of the disclosure herein. Throughout the disclosure, the terms "about" and "approximately" refer to a range of values ±5% of the numeric value that the term precedes.

Example golf club and golf club head structures in accordance with this disclosure may relate to "wood-type" golf clubs and golf club heads, e.g., clubs and club heads typically used for drivers and fairway woods, as well as for "wood-type" utility or hybrid clubs, or the like. Although these club head structures may have little or no actual "wood" material, they still may be referred to conventionally in the art as "woods" (e.g., "metal woods," "fairway woods," etc.). Alternatively, golf club and golf club head structures of the disclosure may relate to "iron-type" golf clubs and golf club heads.

FIG. 1 illustrates a schematic diagram of an example golf club head 10 known in the art. The golf club head 10 includes body 14, a first weight assembly 18, and a second weight assembly 22. The body 14 defines an exterior surface 26 and includes a face 30, a crown 34, and a sole 38. The body 14 further includes a forward-most point 42 disposed on the face 30 and a rearward-most point 46 disposed proximate to a rear portion 50 of the body 14. The golf club head 10 defines a center of gravity 54 and each of the first weight assembly 18 and the second weight assembly 22 define a first center of gravity 58 and a second center of gravity 62, respectively. The first center of gravity 58 is disposed between the face 30 and the golf club head center of gravity 54 within a cavity 66 defined by the body 14. The second center of gravity 62 is disposed between the rear portion 50 and the golf club head center of gravity 54 within the cavity 66.

Each of the first center of gravity 58 and the second center of gravity 62 are located on an axis 70 and define a horizontal distance having a length q therebetween. As illustrated in FIG. 1, a horizontal distance between the forward-most point 42 and the first center of gravity 58 has a length r and a horizontal distance between the rearward-most point 46 and the second center of gravity 62 has a length s. A horizontal distance between the forward-most point 42 and the rearward-most point 46 has a length t. Each of lengths q, r, s, and t are in a direction parallel to a ground plane 74. In the example shown, the ratio between the length between each of the first center of gravity 58 and the second center of gravity 62 (q) and the length between each of the forward-most point 42 and the rearward-most point 46 (t) is less than 80%. For example, the table below demonstrates dimensions for lengths q, r, s, and t as taught by the prior art. As such, FIG. 1 exemplifies that typical construction of a front and rear weighted golf club head fails to produce a ratio greater than 80%, i.e., the preferred ratio, according to the present disclosure.

TABLE 1

Prior art dimensions.

| q (mm) | r (mm) | s (mm) | t (mm) | Ratio: q/t |
|---|---|---|---|---|
| 70.6 | 25.8 | 20.7 | 117.1 | 60.3% |
| 92.5 | 24.9 | 2.0 | 119.4 | 77.5% |

Figure 2:
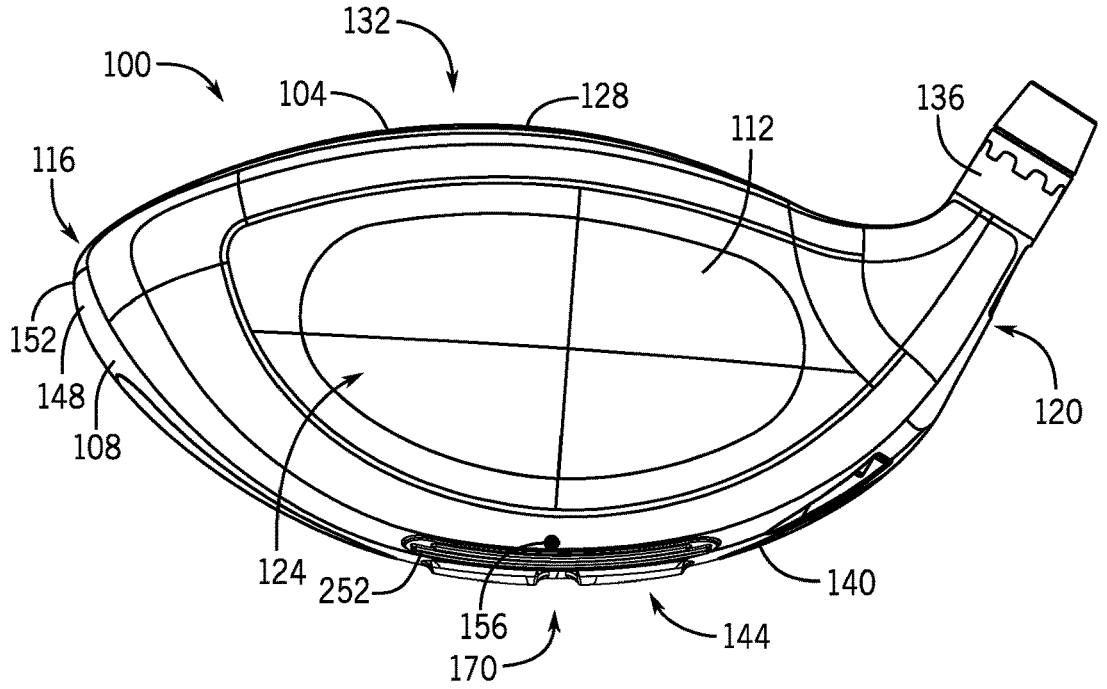
FIG. 2 is a front view of a golf club head that includes a front weight assembly and a rear weight assembly in accordance with the present disclosure.
Figure 3:
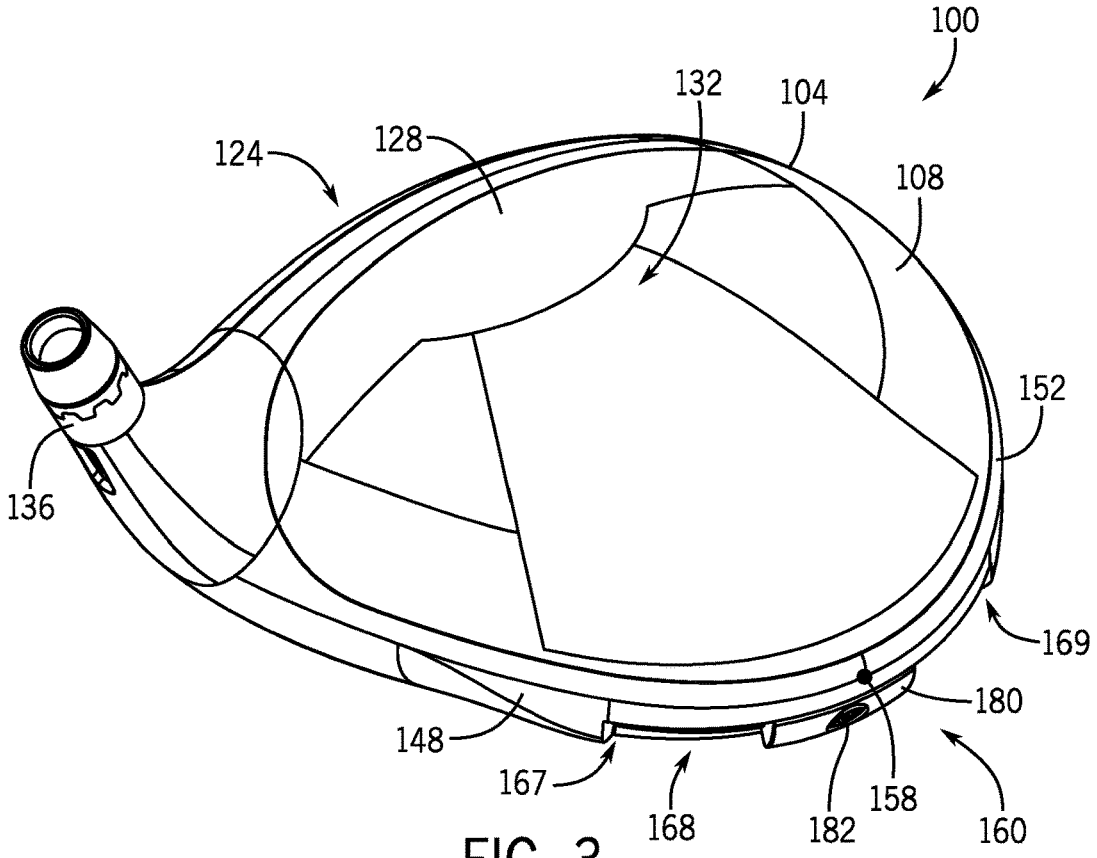
FIG. 3 is a top, right isometric view of the golf club head of FIG. 2.
Figure 4:
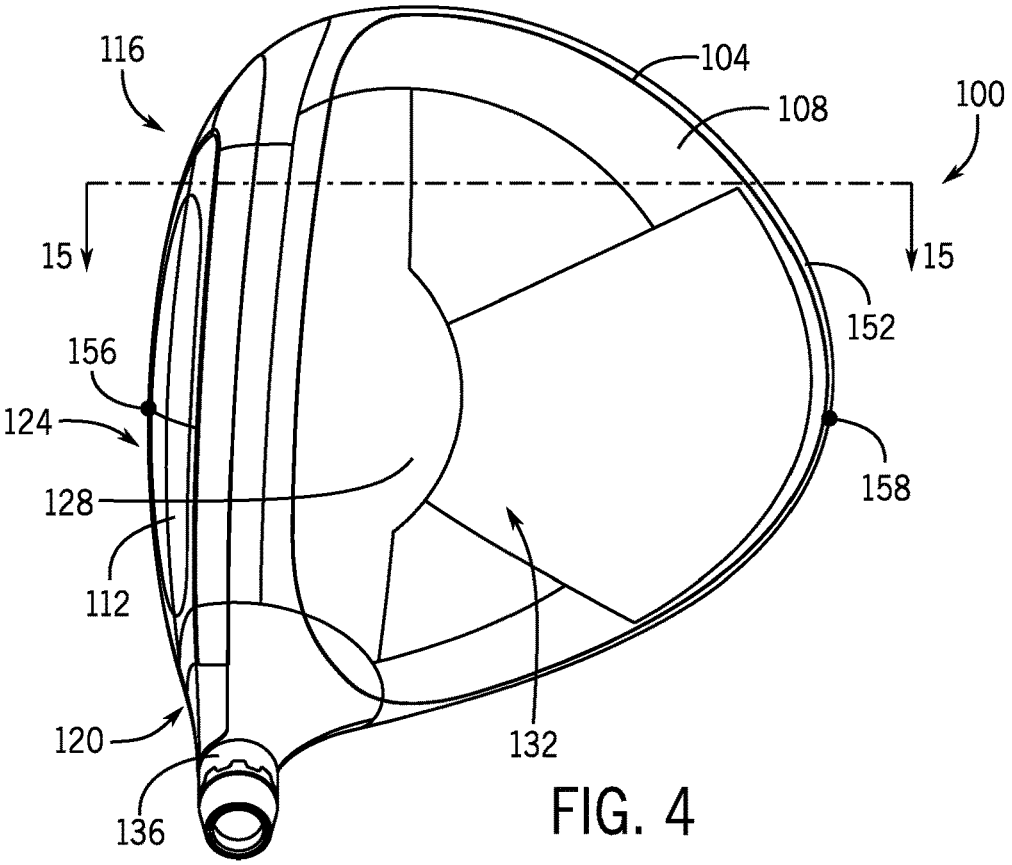
FIG. 4 is a top view of the golf club head of FIG. 2.

FIGS. 2-8 illustrate an example of a golf club head 100 according to an embodiment of the disclosure. As illustrated, the golf club head 100 is a driver-type club. As shown in FIG. 2, the golf club head 100 includes a body 104 that defines an exterior surface 108 and an interior cavity 110 (see, for example, FIGS. 12A-12C). A face 112 extends between a toe 116 and a heel 120 and is positioned at a forward portion 124 of the golf club head 100. As illustrated in FIGS. 3 and 4, the golf club head 100 further includes a crown 128 that defines a top portion 132 of the golf club head 100. A hosel 136 extends from the crown 128, thereby providing a socket (not shown) such that a shaft (not shown) may be coupled to the golf club head 100.

Figure 5:
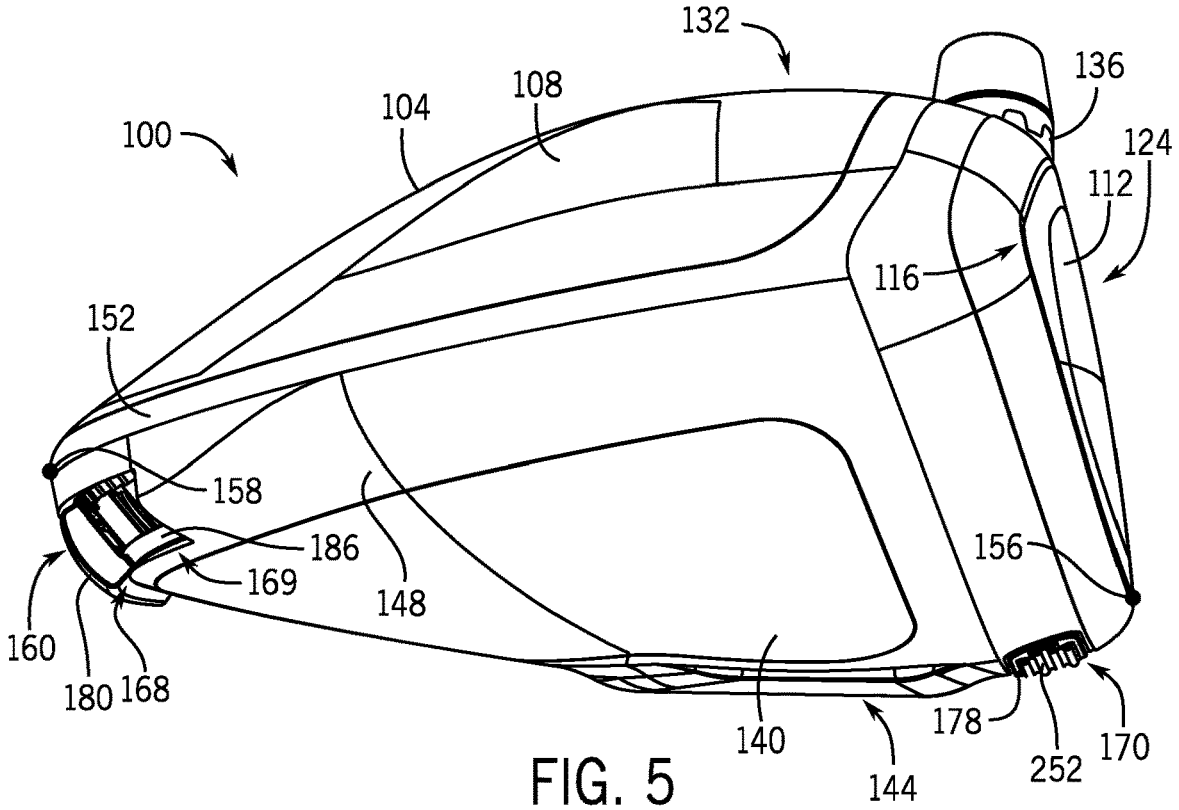
FIG. 5 is a left side view of the golf club head of FIG. 2.
Figure 6:
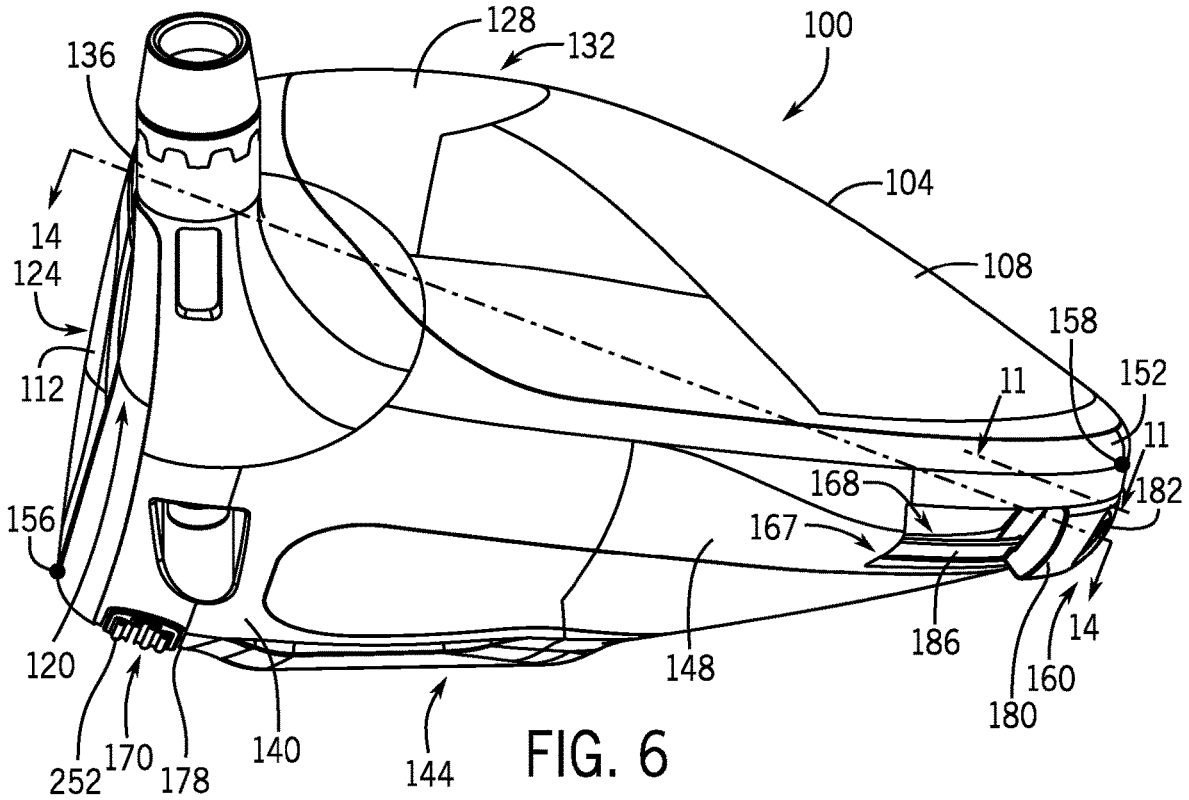
FIG. 6 is a right side view of the golf club head of FIG. 2.

As illustrated in FIGS. 5 and 6, the golf club head 100 further includes a sole 140 that defines a bottom portion 144 of the golf club head 100. A skirt 148 is positioned about a portion of a periphery 152 of the golf club head between the sole 140 and the crown 128. The body 104 further defines a forward-most point 156 and a rearward-most point 158. In the example shown, the forward-most point 156 is defined on the face 112 and the rearward-most point 158 is defined on the periphery 152; however, other configurations are possible. For example, a rearward-most point may be located on any of a crown, skirt, or sole, such that there is a maximum horizontal distance between a forward-most point and the rearward-most point. It should be appreciated that other configurations of the body 104 illustrated in FIGS. 2-8 are possible and that the relative dimensions of the structural components of the body 104 as illustrated in FIGS. 2-8 are non-limiting.

Figure 7:
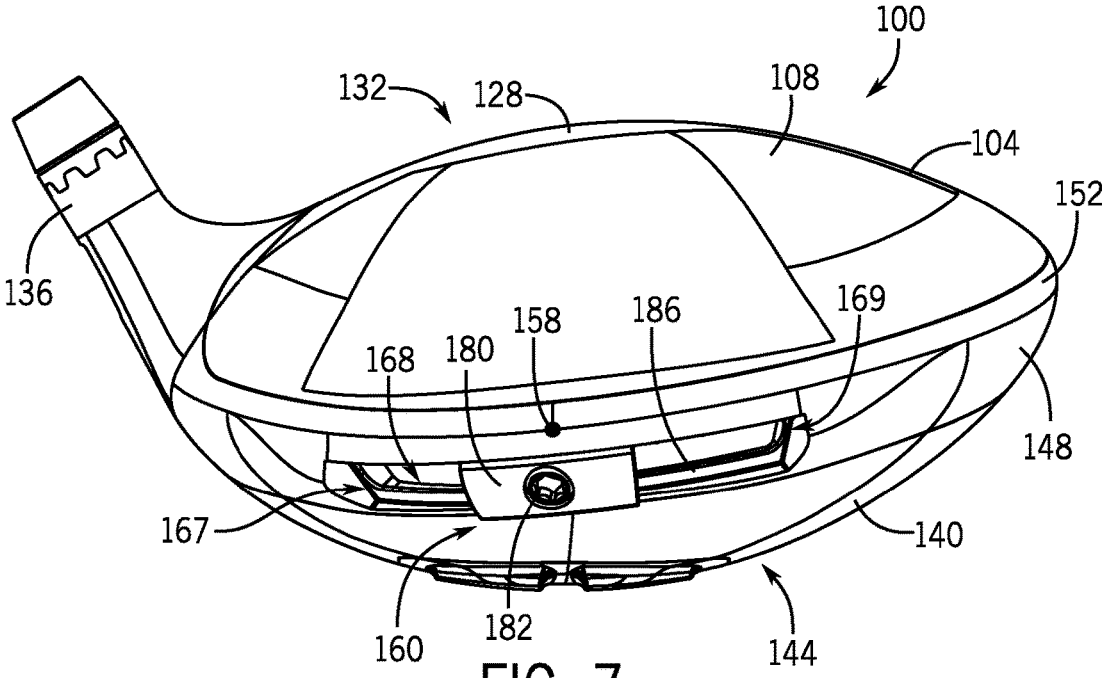
FIG. 7 is a rear view of the golf club head of FIG. 2.

As illustrated in FIG. 7, the golf club head 100 further includes a rear weight assembly 160. The rear weight assembly 160 defines a rear weight center of gravity 164 (see, for example, FIG. 12A) and includes an elongated aperture 168 that extends within at least a portion of the exterior surface 108. In the illustrated embodiment, the elongated aperture 168 is formed in the skirt 148 and extends between a first end 167 and a second end 169; however, other configurations are possible. For example, a golf club head may include an elongated aperture configured to receive a weight and is at least partially formed in one or more of a sole, a skirt, and a crown. Additional details regarding the rear weight assembly 160 will be provided below with reference to FIGS. 10-12.

Figure 8:
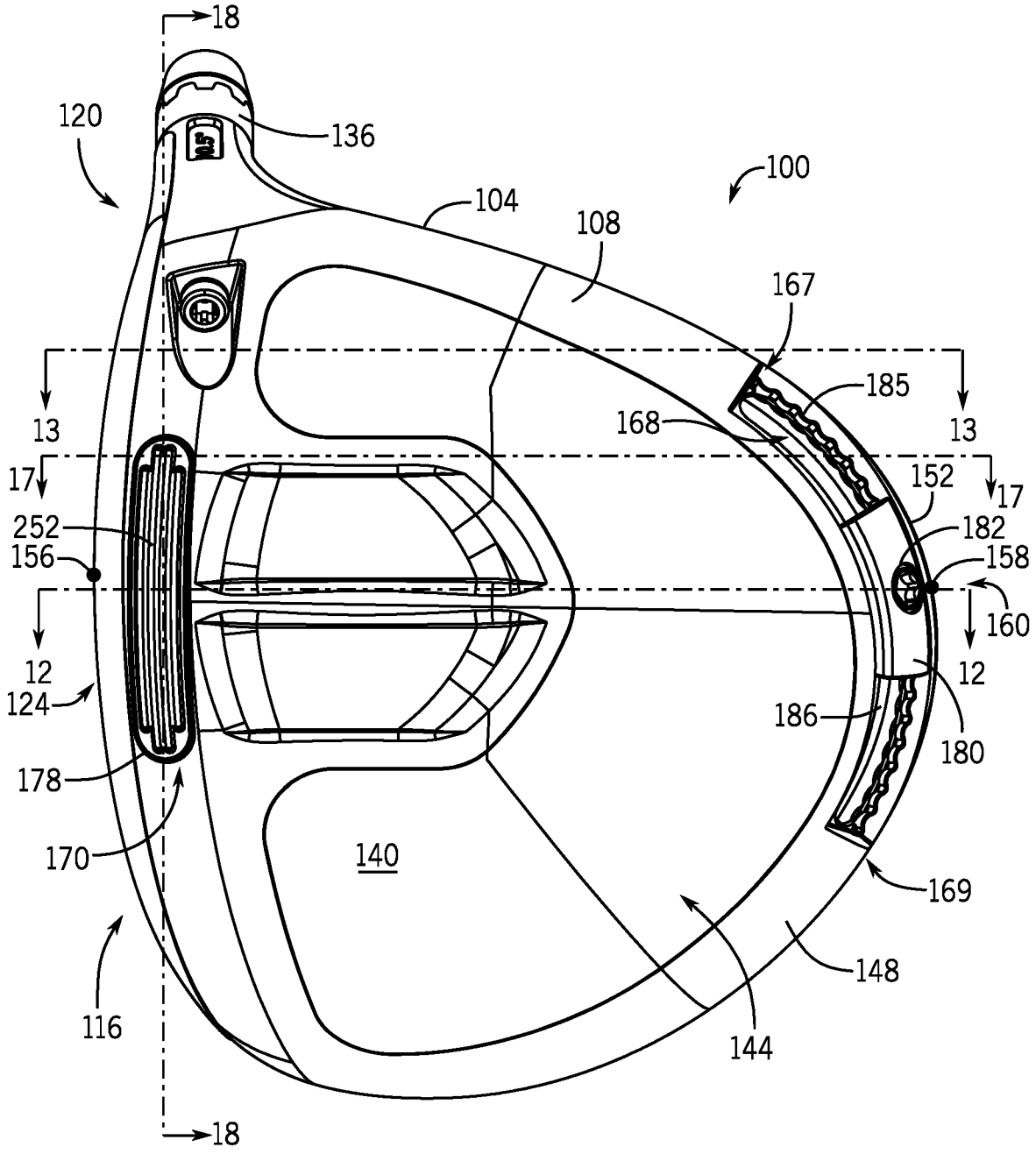
FIG. 8 is a bottom view of the golf club head of FIG. 2.

As illustrated in FIG. 8, the golf club head 100 further includes a front weight assembly 170 that extends between the toe 116 and the heel 120. Similar to the rear weight assembly 160, the front weight assembly 170 defines a front weight center of gravity 174 (see, for example, FIG. 12A). The front weight assembly 170 is received proximate to a front weight aperture 178 formed in the sole 140; however, other configurations are possible. For example, a golf club head may include a front weight assembly in a variety of locations and configurations in an interior cavity of the golf club head, thereby fully containing the front weight assembly within the golf club head. Additionally, a golf club head may include a front weight assembly coupled to a portion of an exterior surface of the golf club head. Additional details regarding the front weight assembly 170 will be provided below with reference to FIGS. 13-18.

Figure 9:
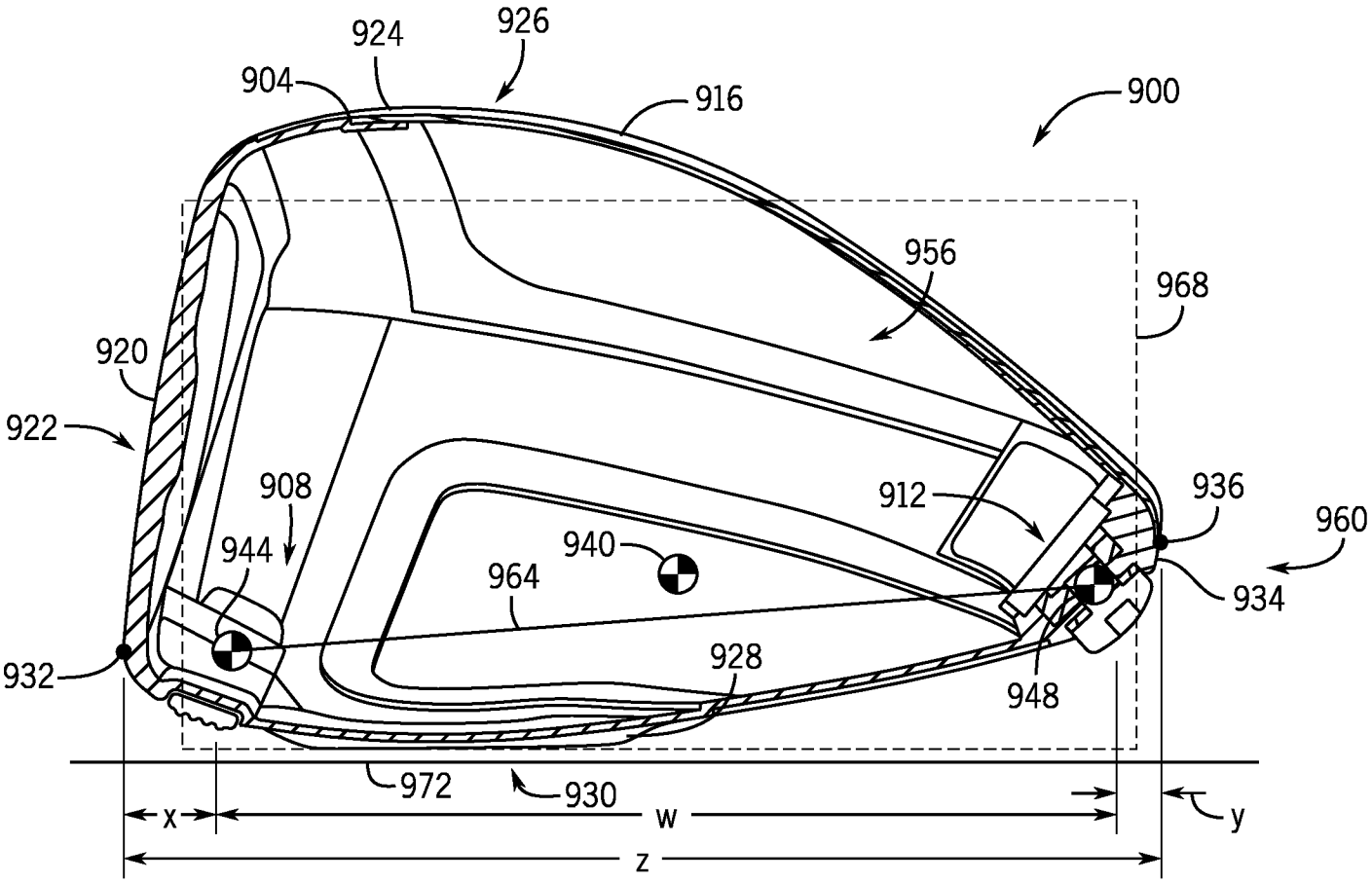
FIG. 9 is a side view of a golf club head diagram including an example of a relative distance between a front weight assembly and a rear weight assembly in accordance with the present disclosure.

FIG. 9 illustrates a schematic diagram of an example golf club head 900 in accordance with the present disclosure. In some embodiments, the golf club head 100 may include aspects or elements that are similar or identical to the golf club head 900 depicted in the schematic; however, unique reference numbers will be used to describe the golf club head 900 below.

The golf club head 900 includes body 904, a first weight assembly 908, and a second weight assembly 912. The body 904 defines an exterior surface 916 and includes a face 920 within a forward portion 922 of the golf club head 900 that extends between a toe and a heel (not shown). The body further includes a crown 924 that defines a top portion 926 of the golf club head 900, a sole 928 that defines a bottom portion 930 of the golf club head 900, and a skirt 934 positioned about at least a portion of a periphery of the golf club head 900 between the crown 924 and the sole 928. The body 904 further includes a forward-most point 932 disposed on the face 920 and a rearward-most point 936 disposed on the skirt 934.

The golf club head 900 defines a center of gravity 940, and each of the first weight assembly 908 and the second weight assembly 912 define a first center of gravity 944 and a second center of gravity 948, respectively. The first center of gravity 944 is positioned within the forward portion 922 and within a cavity 956 defined by the body 904. The second center of gravity 948 is positioned within a rear portion 960 and also within the cavity 956 defined by the body 904.

Each of the first center of gravity 944 and the second center of gravity 948 are located on an axis 964 within a vertical plane 968 that is perpendicular to a ground plane 972 and define a horizontal distance having a length w therebetween. As such, length w defines a weight system length. As illustrated in FIG. 9, a horizontal distance between the forward-most point 932 and the first center of gravity 944 has a length x and a horizontal distance between the rearward-most point 936 and the second center of gravity 948 has a lengthy. A horizontal distance between the forward-most point 932 and the rearward-most point 936 has a length z. As such, length z defines a horizontal club head length. Each of lengths w, x, y, and z are in a direction parallel to the ground plane 972 and are measured within the vertical plane 968. In the example shown, the ratio between the weight system length (w) and the horizontal club head length (z) is greater than 80%. For example, the table below demonstrates preferred dimensions for lengths w, x, y, and z according to the present disclosure. It should be understood that the dimensions in Table 2 are by way of example, and other dimensions are possible to achieve a ratio of 80% or greater. In another embodiment, the preferred ratio may be between 80% and 99%.

TABLE 2

Preferred dimensions according to the present disclosure.

| w (mm) | x (mm) | y (mm) | z (mm) | Ratio: w/z |
|---|---|---|---|---|
| 103.8 | 9.9 | 5.2 | 118.9 | 87.3% |
| 101.5 | 10.3 | 5.5 | 117.3 | 86.5% |
| 101.7 | 11.8 | 5.1 | 118.6 | 85.8% |
| 69.9 | 11.8 | 3.6 | 85.3 | 81.9% |

Figure 10:
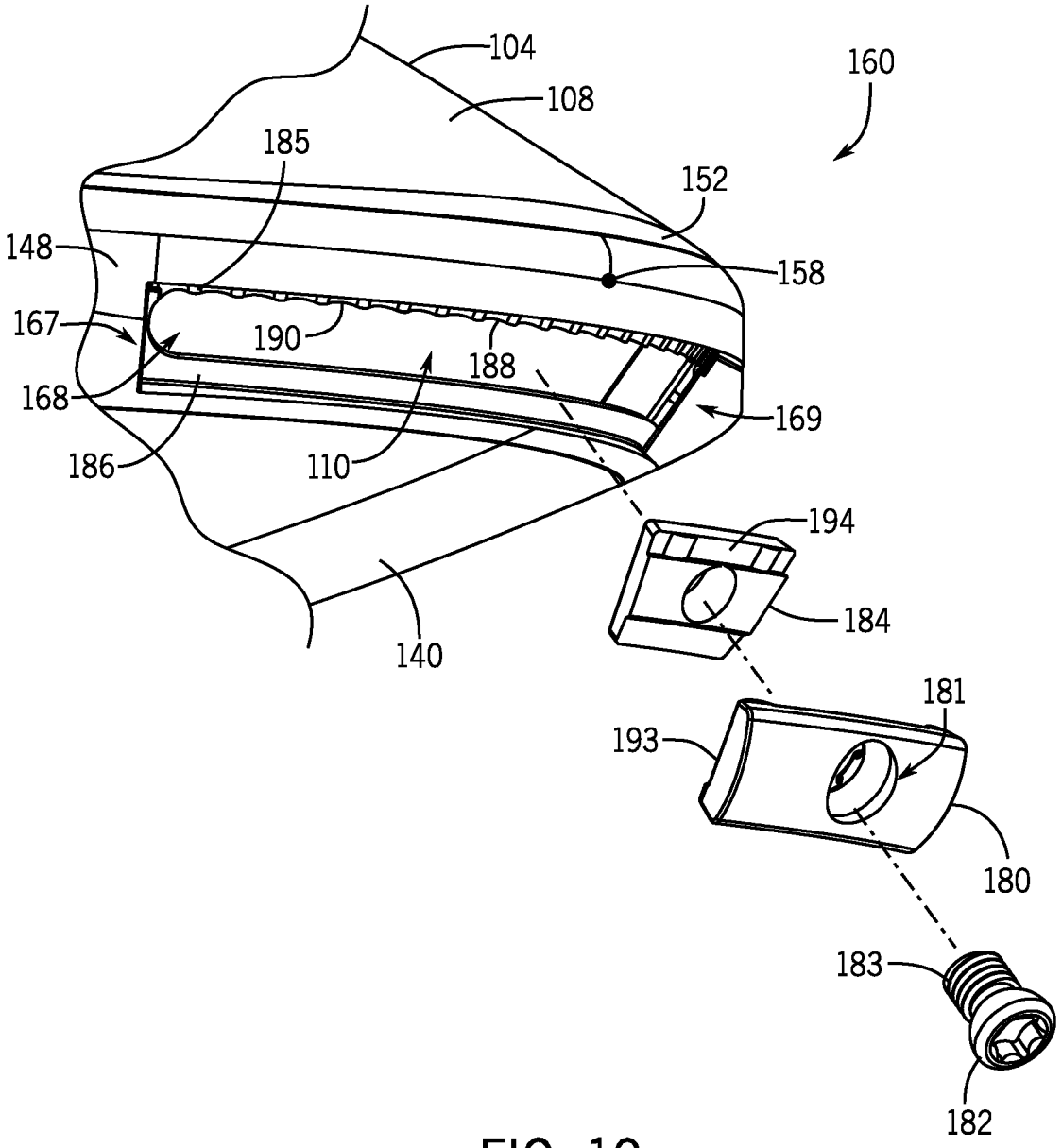
FIG. 10 is an exploded assembly view of the rear weight assembly in accordance with the present disclosure.
Figure 11:
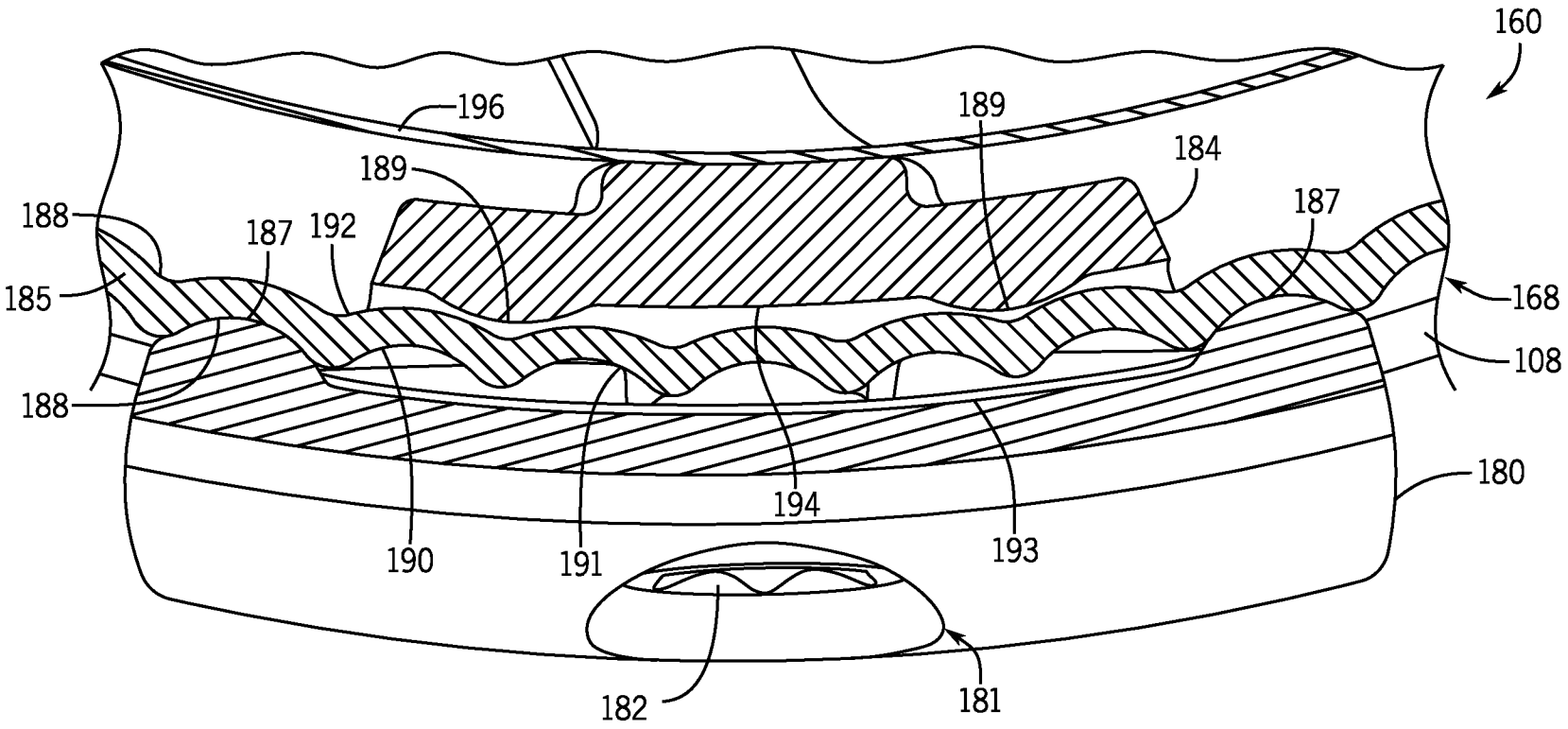
FIG. 11 is a partial cross-sectional view of the rear weight assembly taken through line 11-11 of FIG. 6.

FIGS. 10-18 refer back to the golf club head 100. In particular, FIGS. 10-12 illustrate the rear weight assembly 160 according to one embodiment. As illustrated in FIG. 10, the rear weight assembly 160 includes the weight 180, a fastener 182, and a nut 184. In the example shown, the fastener 182 is configured as a screw that includes threads 183 that threadably engage the nut 184. The fastener 182 is dimensioned to engage the weight 180 and extend through both a weight aperture 181 and the elongated aperture 168. As shown, the elongated aperture 168 is at least partially defined by an upper flange 185 and a lower flange 186 that extend inwardly from a perimeter that defines the elongated aperture 168, thereby defining a track that the weight 180 and nut 184 are slidable along. In the illustrated embodiment, the weight 180 is generally secured to the body 104 via the engagement of the fastener 182 and the nut 184 with the upper flange 185 and the lower flange 186; however, other configurations are possible. For example, the weight 180 may be secured to the body 104 via bolt, rivet, interference fit, etc.

As shown in FIG. 11, the weight 180 includes protrusions 187 that are dimensioned to engage one or more engagement features 188. Similarly, the nut 184 includes protrusions 189 that are dimensioned to engage one or more engagement features 188. In the example shown, the engagement features 188 are scalloped recesses 190 that are disposed on an outer surface 191 and an inner surface 192 of the upper flange 185. As such, the protrusions 187 of the weight 180 engage the scalloped recesses 190 on the outer surface 191 and the protrusions 189 of the nut 184 engage the scalloped recess 190 on the inner surface 192. The scalloped recesses 190 define a plurality of discrete positions along the elongated aperture 168 that the weight 180 and the nut 184 are slidable between. In the example shown, the plurality of discrete positions is 15 positions; however, other configurations are possible. For example, there may be between 2 and 30 discrete positions, or between 6 and 22 discrete positions. In other embodiments, the weight 180 may be slid to any number of positions between the first end 167 and the second end 169.

In one embodiment, the scalloped recesses 190 are disposed on the upper flange 185; however, it should be appreciated that other configurations are possible. For example, scalloped recesses may be disposed on one or more of an inner surface of an upper flange, an outer surface of an upper flange, an inner surface of a lower flange, and an outer surface of a lower flange. It should also be appreciated that the specific shape of the scalloped recesses 190 is not critical for providing a plurality of discrete positions. For example, the engagement features 188 may have alternative profiles, such as triangular, for example. Additionally, in the example shown, each of the upper flange 185 and the lower flange 186 comprise titanium. In other embodiments, the upper flange 185 and the lower flange 186 may comprise one or more of titanium, titanium alloys, stainless steel, steel alloys, aluminum, zinc, carbon graphite, zirconium, beryllium copper, copper alloys, maraging steel, tungsten, tungsten alloys, amorphous metal alloys, magnesium, magnesium alloys, high-strength plastic, high-strength polymers, etc.

In one embodiment, the weight 180 includes a concave curved surface 193 that defines a first radius of curvature. Additionally, a portion of the exterior surface 108 of the golf club head 100, adjacent to the rearward-most point 158, defines a second radius of curvature that is substantially identical to the first radius of curvature of the concave curved surface 193. Similarly, the nut 184 defines a convex curved surface 194 that defines a third radius of curvature that is substantially identical to the first radius of curvature of the concave curved surface 193. As such, when each of the weight 180 and the nut 184 are slid between the plurality of discrete positions, the concave curved surface 193 and the convex curved surface 194 remain substantially parallel.

Figure 12A:
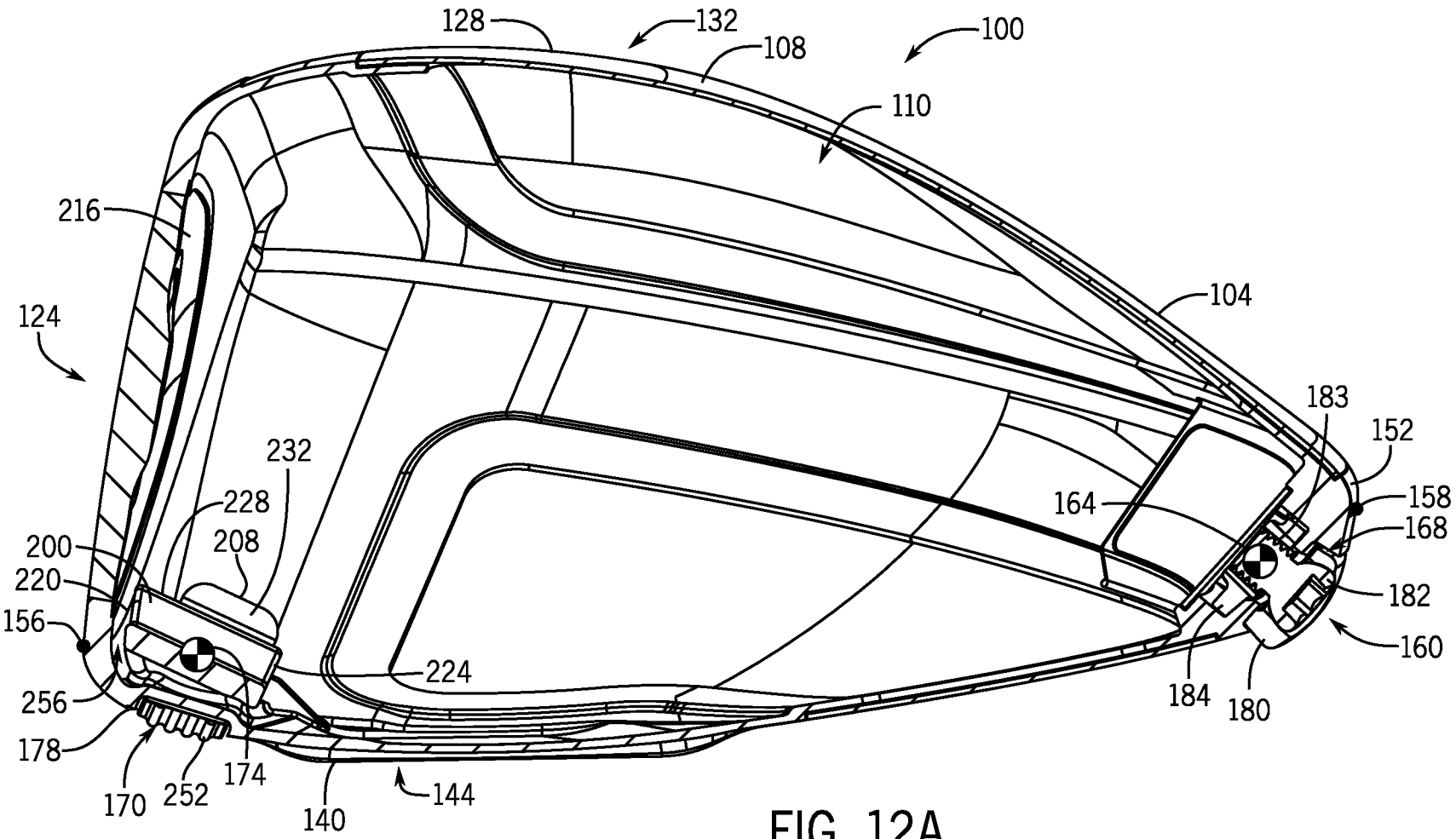
FIG. 12A is a right side cross-sectional view taken through line 12-12 of FIG. 8.
Figure 12B:
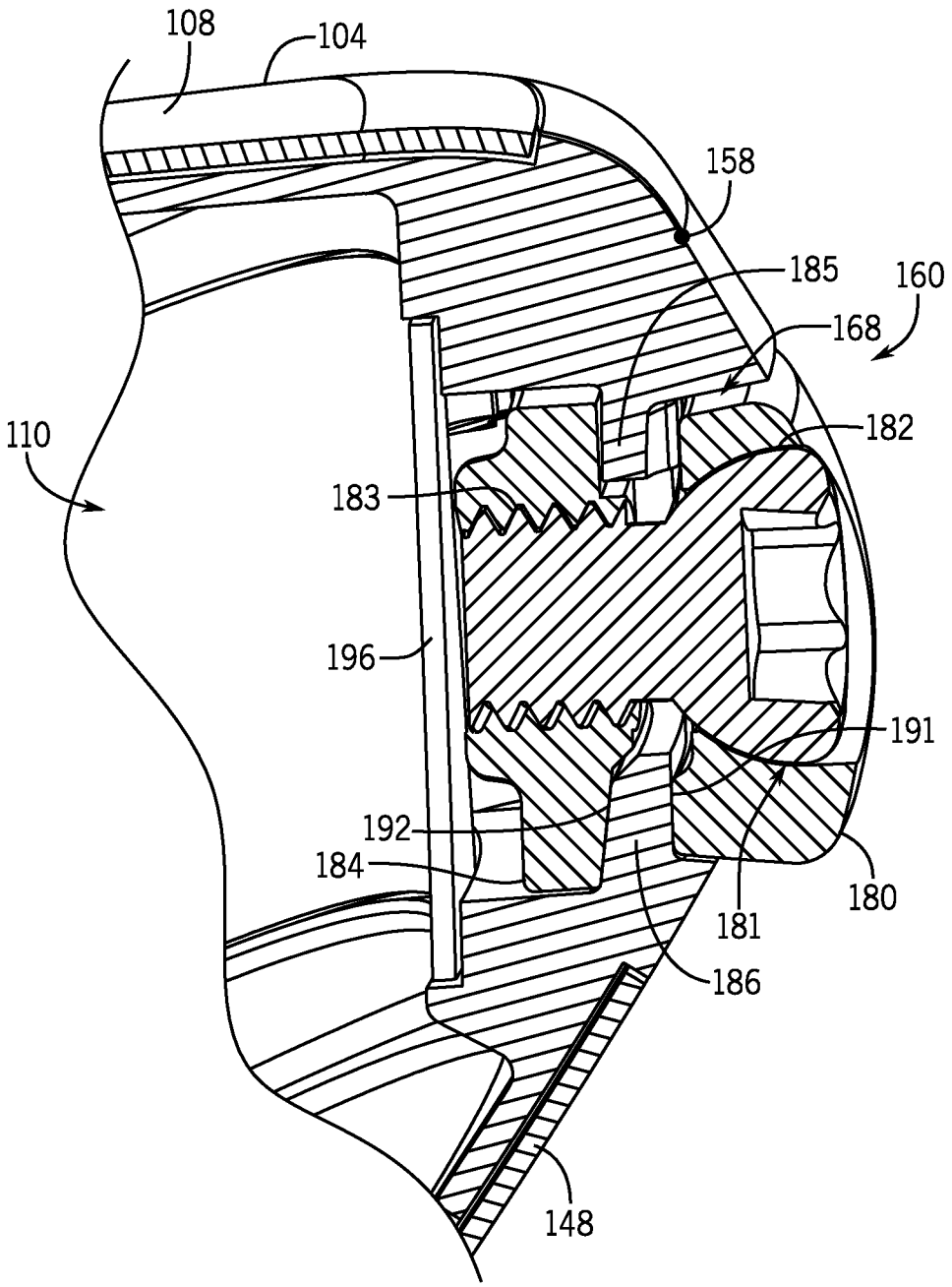
FIG. 12B is a partial cross-sectional view of the rear weight assembly taken through line 12-12 of FIG. 8.
Figure 12C:
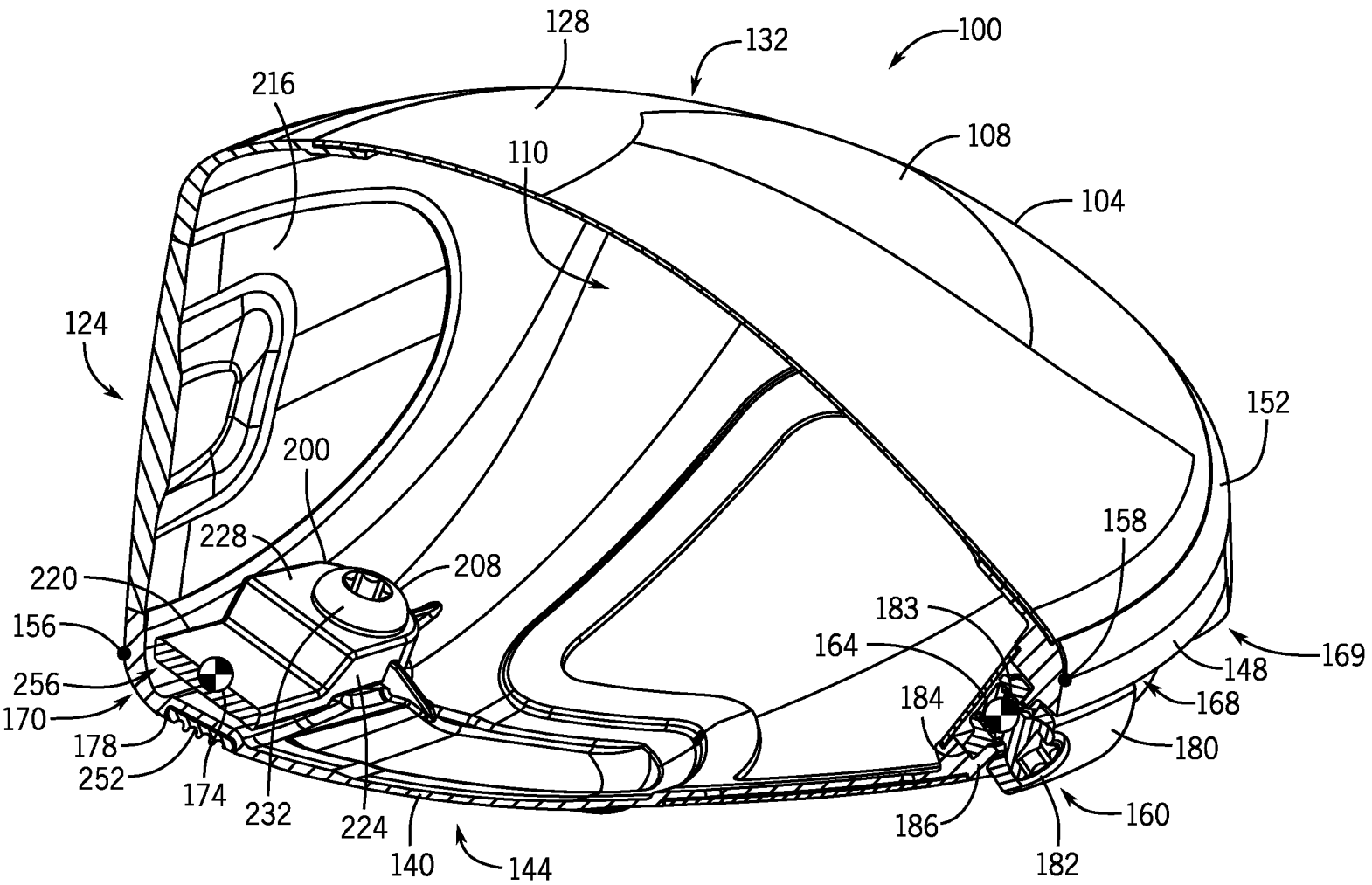
FIG. 12C is a rear, right isometric cross-sectional view taken through line 12-12 of FIG. 8.
Figure 13:
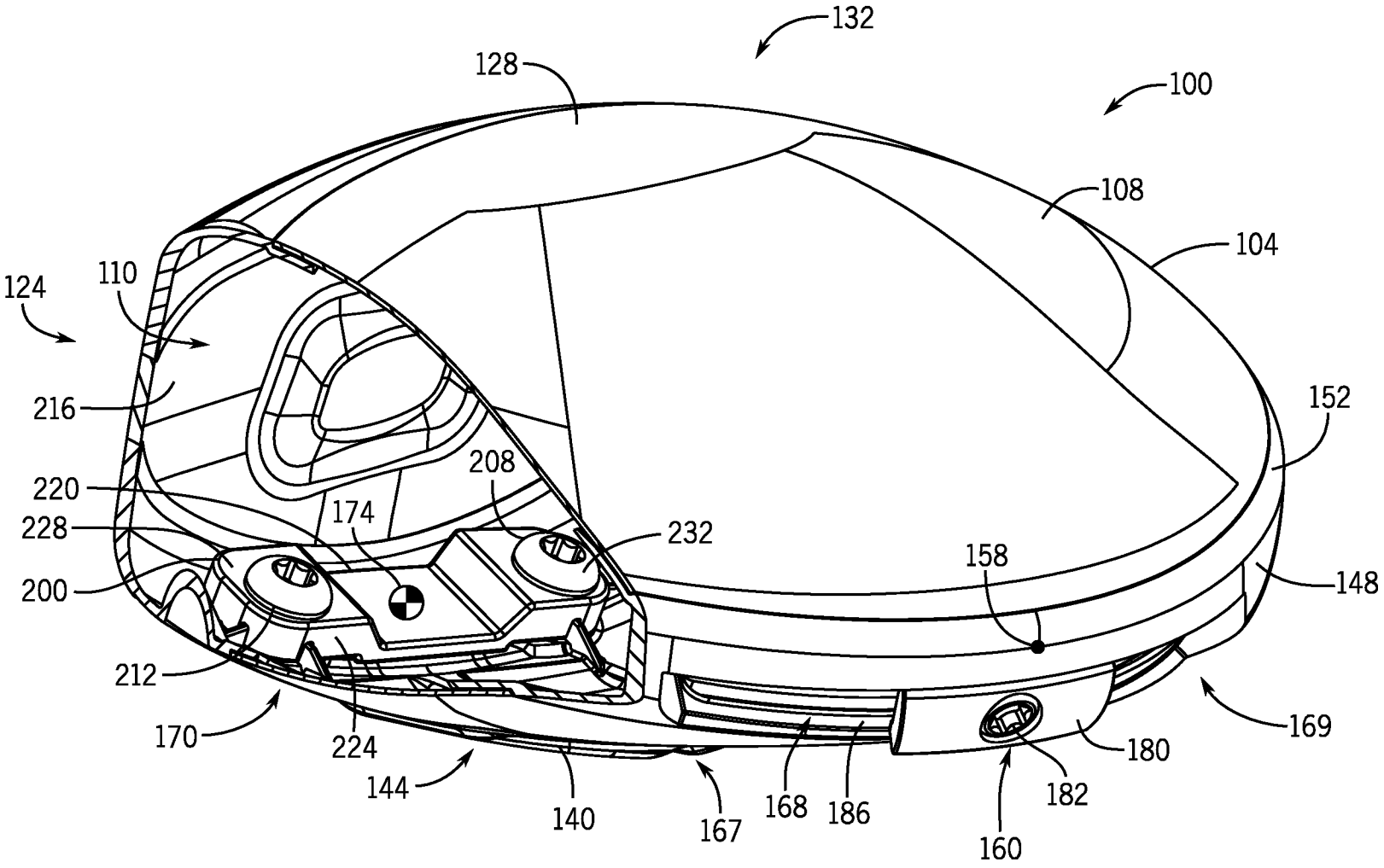
FIG. 13 is a rear, right isometric cross-sectional view taken through line 13-13 of FIG. 8.
Figure 14:
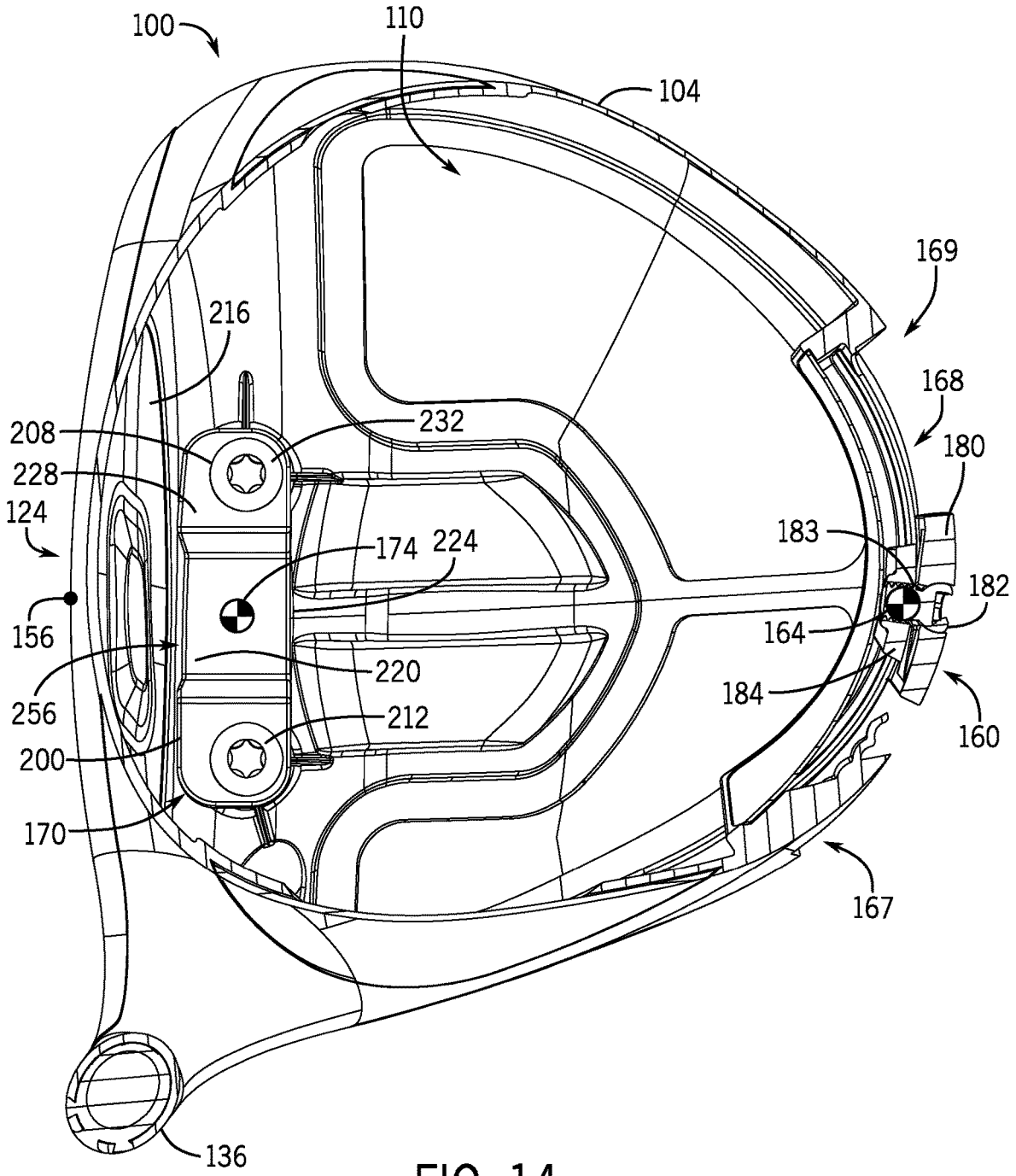
FIG. 14 is a top cross-sectional view taken through line 14-14 of FIG. 6.

As shown in FIGS. 12A and 12C, the rear weight assembly 160 defines the rear weight center of gravity 164. The scalloped recesses 190 allow the rear weight center of gravity 164 to be adjusted between the first end 167 and the second end 169 of the elongated aperture 168. In use, according to one example, the fastener 182 may be rotated in a first direction, thereby unscrewing the threads 183 from the nut 184. The weight 180 and the nut 184 may be slid to any one of the plurality of discrete positions along the elongated aperture 168. The fastener 182 may then be rotated in a second direction, thereby securing the weight 180 between the fastener 182, each of the upper flange 185 and the lower flange 186, and the nut 184. As further illustrated in FIG. 12B, the nut 184 is secured within the elongated aperture 168 between the inner surface 192 of each of the upper flange 185 and the lower flange 186 and a rear wall 196. In the illustrated embodiment, the rear wall 196 separates the elongated aperture 168 from the interior cavity 110 of the body 104.

Referring now to FIGS. 13-18, the front weight assembly 170 is shown. The front weight assembly 170 includes a front weight plate 200 that is fixed in the interior cavity 110. The front weight plate 200 is secured via first and second fasteners 208, 212 adjacent to, but not in contact with, an interior surface 216 of the face 112, according to an embodiment. The front weight plate 200 includes a front face 220, a rear face 224, and a top mounting surface 228 disposed therebetween. In the illustrated embodiment, the front weight plate 200 is secured in the interior cavity 110 by the first and second fasteners 208, 212; however, other configurations are possible. For example, a golf club head may include a front weight assembly having a front weight plate secured by a single fastener.

Figure 15:
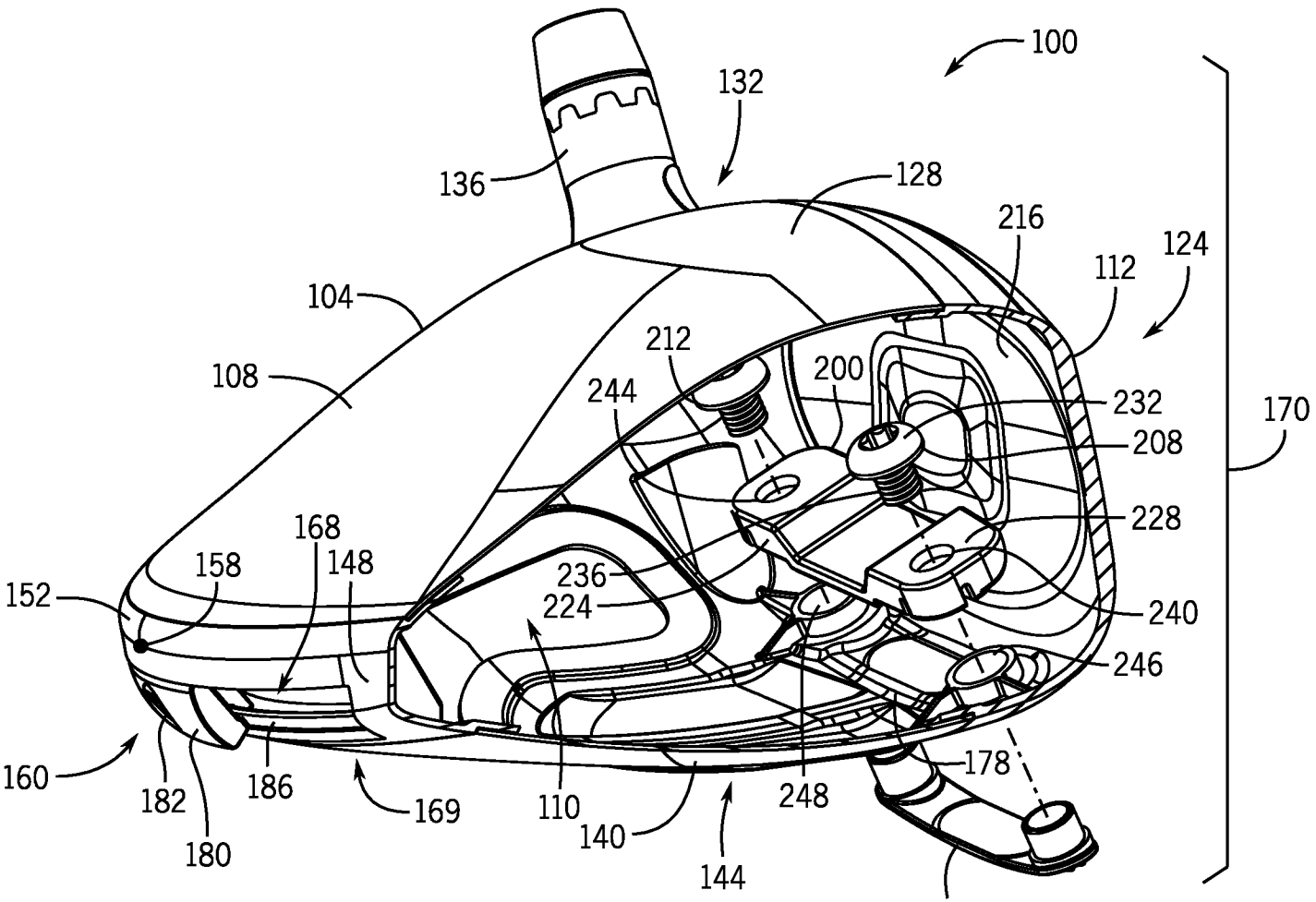
FIG. 15 is a rear, left isometric cross-sectional view taken through line 15-15 of FIG. 4, including an exploded view of the front weight assembly.

FIG. 15 illustrates an example of an exploded view of the front weight assembly 170. Each of the first and second fasteners 208, 212 include a head 232 that is configured to engage the top mounting surface 228. Additionally, each of the first and second fasteners 208, 212 include a shaft 236 that is configured to be received by both first and second mounting holes 240, 244 and first and second cavity mounts 246, 248, respectively. The cavity mounts 246, 248 are configured as bosses that are formed in the sole 140 of the interior cavity 110. The cavity mounts 246, 248 extend between the interior cavity 110 and the exterior surface 108. The front weight assembly 170 further includes a sole mount 252 that is dimensioned to be received in the front weight aperture 178 bordering the exterior surface 108 and engage a counter bore surface 195 (see, for example, FIG. 17). In the example shown, the sole mount 252 acts as a nut that is configured to receive each of the shafts 236 of the first and second fasteners 208, 212, thereby securing the front weight plate 200 to the body 104; however, other configurations are possible. Additional examples of a front weight assembly will be described below with respect to FIGS. 21-33.

Figure 16:
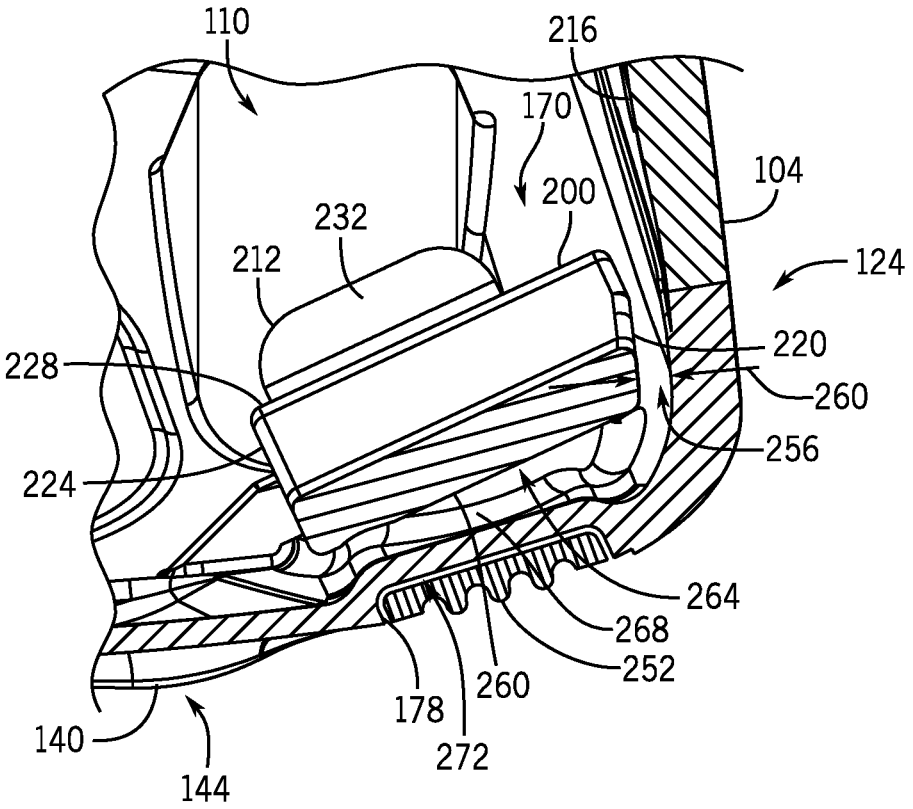
FIG. 16 is a partial left side assembled view of the front weight assembly of FIG. 15.
Figure 17:
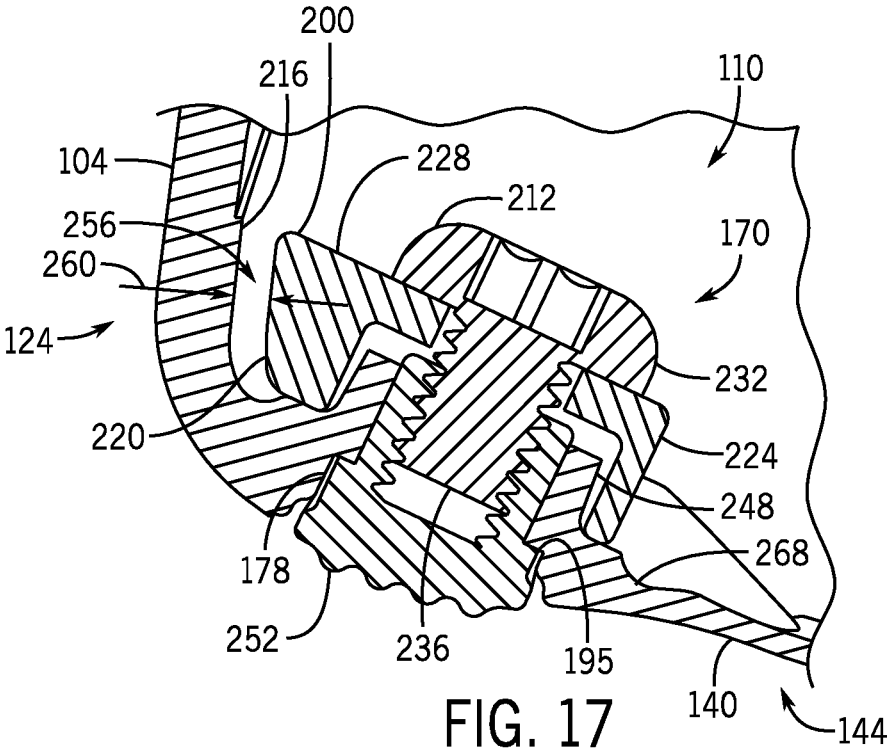
FIG. 17 is a partial right cross-sectional view of the front weight assembly taken through line 17-17 of FIG. 8.

Illustrated in FIGS. 16 and 17 is a face gap 256 defined between the front face 220 of the front weight plate 200 and the interior surface 216 of the face 112. In the example shown, the face gap 256 has a width 260 of about 1.25 millimeters; however, other configurations are possible. For example, the width 260 may be between about 0.5 millimeters and about 6 millimeters, or about 1 millimeter and about 4 millimeters. A variety of widths is contemplated so long as the ratio, as described above with respect to FIG. 9, is over 80%. The face gap 256 allows the face 112 to flex and deform when the golf club head 100 strikes a ball, particularly at a center portion of the face 112. The face gap 256 prevents the interior surface 216 of the face 112 from contacting the front weight plate 200 and further prevents the front weight plate 200 from interfering with the elasticity of the face 112.

Figure 18:
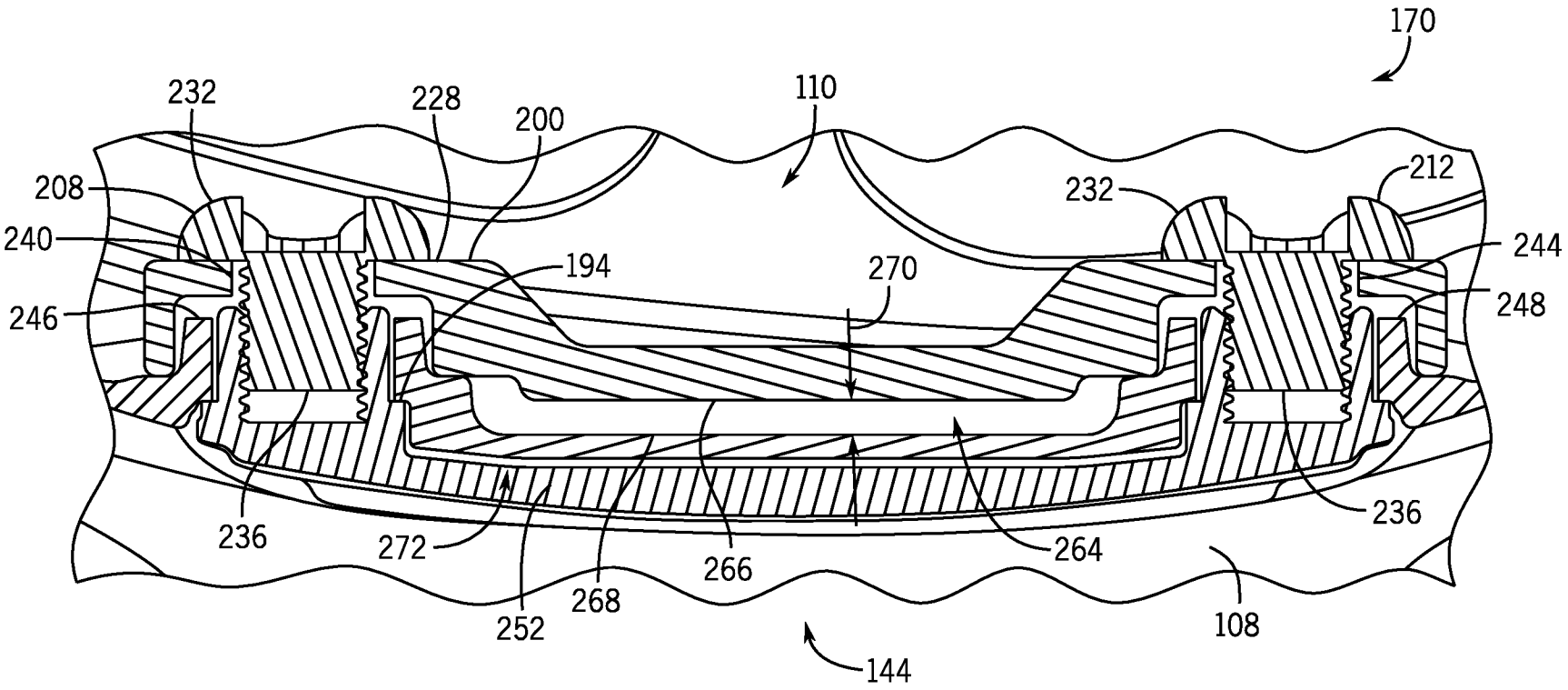
FIG. 18 is a partial front isometric cross-sectional view taken through line 18-18 of FIG. 8.

Referring now to FIG. 18, a sole gap 264 is defined between a bottom 266 of the front weight plate 200 and an interior surface 268 of the sole 140. In the example shown, the sole gap 264 has a height 270 of about 1.25 millimeters; however, other configurations are possible. For example, the height 270 may be between about 0.5 millimeters and about 6 millimeters, or about 1 millimeter and about 4 millimeters. The sole gap 264 allows the sole 140 to flex and deform when the golf club head 100 strikes a ball. The sole gap 264 prevents the interior surface 268 of the sole 140 from contacting the front weight plate 200 and further prevents the front weight plate 200 from interfering with the elasticity of the golf club head 100, and, in particular, the sole 140.

Additionally, a sole mount gap 272 between the sole mount 252 and the exterior surface 108, and, in particular, the interior surface 268 of the sole 140, promotes flexibility in the golf club head 100. The sole mount gap 272 may have similar or identical dimensional ranges as the face gap 256 and the sole gap 264 described above.

In one embodiment, the front weight plate 200 has a first density and the body 104 has a second density. In one example, the first density is greater than the second density. For example, the front weight plate 200 may have a density between about 2.5 grams per cubic centimeter and about 25 grams per cubic centimeter and the body 104 may have a density between about 2 grams per cubic centimeter and 15 grams per cubic centimeter. In some embodiments, the front weight plate 200 may comprise one or more of stainless steel, tungsten, zirconium, copper, brass, and aluminum, for example. In one non-limiting example, each of the rear weight assembly 160 and the front weight assembly 170 has a mass between about 1 gram and about 100 grams, or between about 2 grams and about 60 grams. As a result, the sum of the masses of the rear weight assembly 160 and the front weight assembly 170 is between about 10 grams and about 80 grams, or between about 20 grams and about 70 grams, or about 62 grams.

Figure 19:
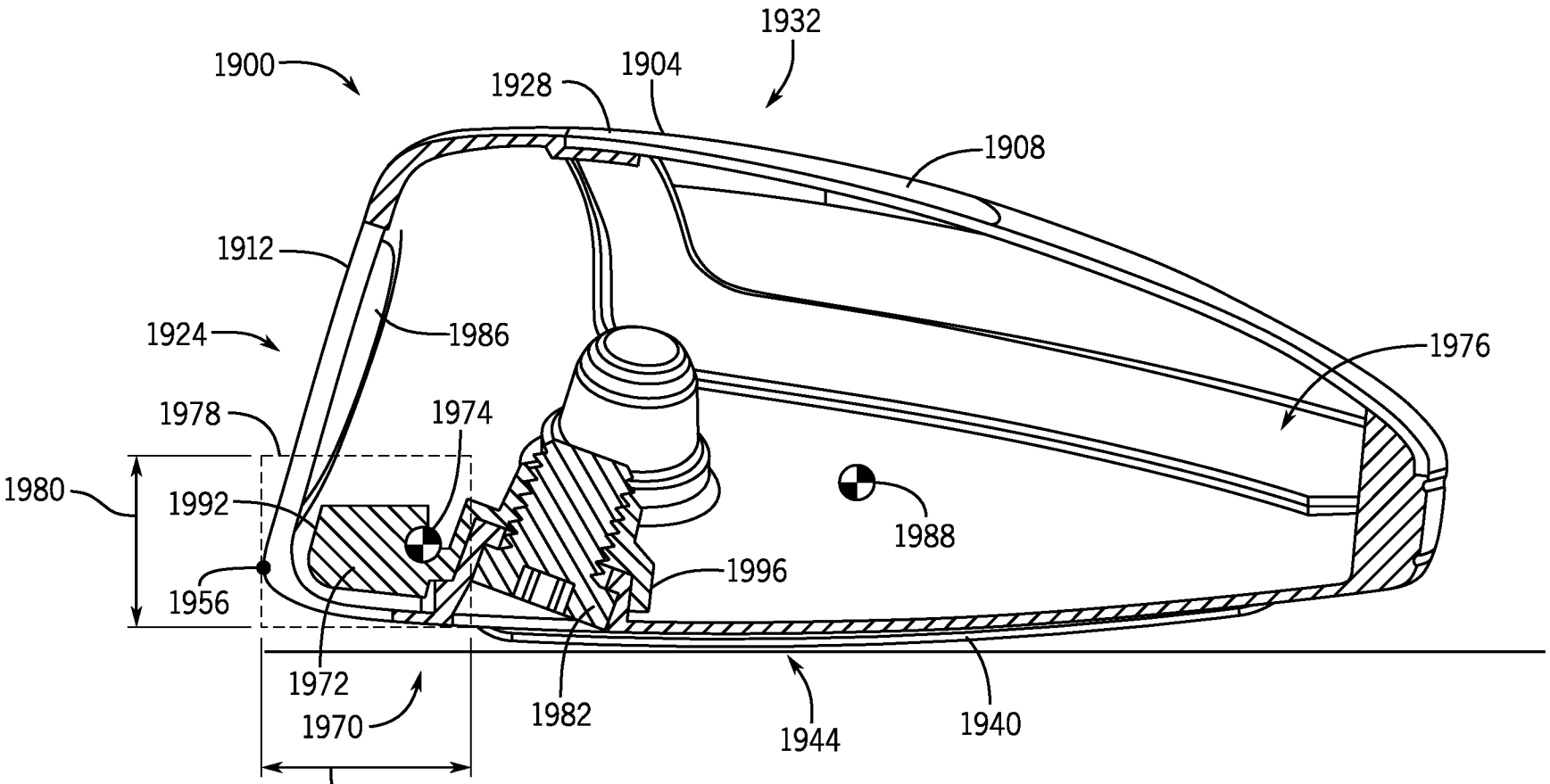
FIG. 19 is a diagrammatic right side view of a golf club head including an example of a positioning of a front weight assembly relative to a center of gravity of a golf club head.

Now referring to FIG. 19, a schematic diagram of an example golf club head 1900 in accordance with the present disclosure is illustrated. As illustrated, the golf club head 1900 is a fairway wood-type club; however, in some embodiments, the golf club head 100 may include aspects or elements that are similar or identical to the golf club head 1900 depicted in the schematic. Specifically, the front weight assembly 170 can include dimensions similar or identical to the dimensions associated with a front weight assembly 1970 depicted in the schematic. Like-reference numbers, as used with respect to the golf club head 100 and where applicable, will be used to describe the golf club head 1900 below.

The golf club head 1900 defines a club head center of gravity 1988 and includes a body 1904 that defines an exterior surface 1908. The body 1904 includes a face 1912 that is positioned at a forward portion 1924 of the golf club head 1900. The body 1904 further includes a crown 1928 that defines a top portion 1932 of the golf club head 1900 and a sole 1940 that defines a bottom portion 1944 of the golf club head 1900. The body 1904 further defines a forward-most point 1956. In the example shown, the forward-most point 1956 is defined on the face 1912; however, other configurations are possible. The golf club head 1900 further includes the front weight assembly 1970 that defines a front weight center of gravity 1974.

The front weight assembly 1970 includes a front weight plate 1972 fixed in an interior cavity 1976 defined by the body 1904 and secured by a fastener 1982 adjacent to an interior surface 1986 of the face 1912 according to one embodiment. The front weight plate 1972 includes a front face 1992 proximate to the interior surface 1986 and a rear face 1996. In the illustrated embodiment, the front weight center of gravity 1974 resides within a rectangular area 1978 having a height 1980 between about 2.5 millimeters and about 20 millimeters, or between about 8 millimeters and about 16 millimeters, or about 12.5 millimeters. The rectangular area 1978 also has a width 1984 between about 5 millimeters and about 25 millimeters, or between about 12 millimeters and about 18 millimeters, or about 15 millimeters based on the forward-most point 1956. As such, the rear face 1996 is between about 5 millimeters and 35 millimeters, or between about 10 millimeters and about 30 millimeters from the interior surface 1986 in a horizontal direction.

Figure 20:
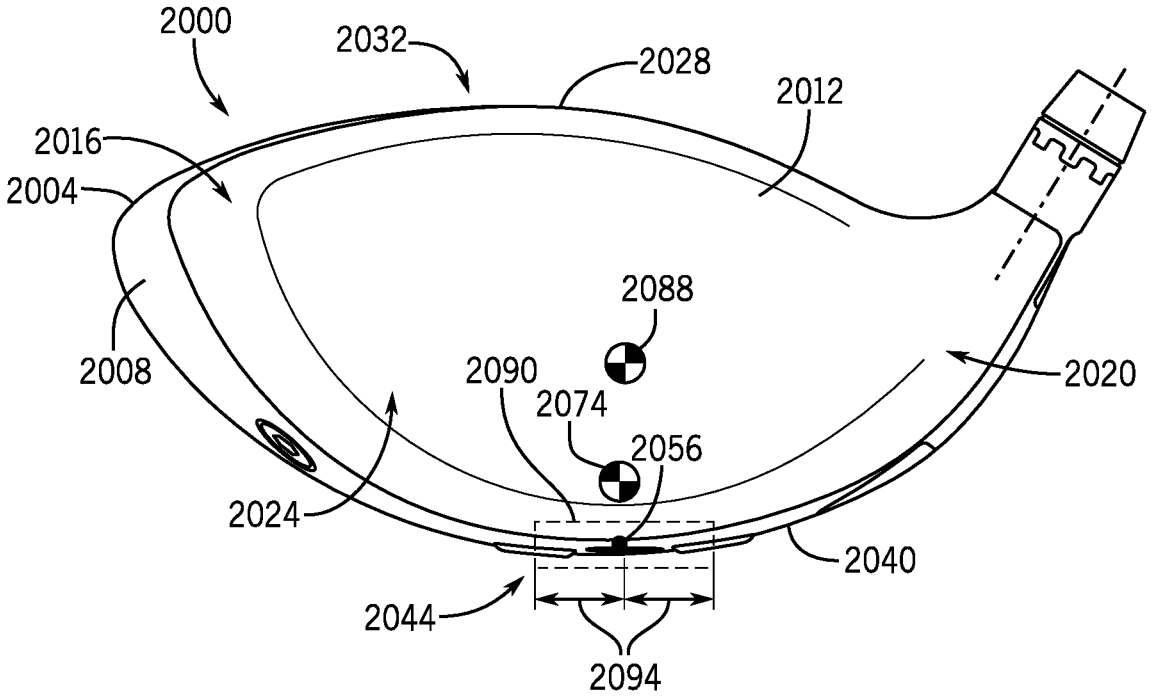
FIG. 20 is a diagrammatic front view of a golf club head including an example of a distance of a center of gravity of a front weight assembly relative to a center of gravity of a golf club head.

Referring now to FIG. 20, a schematic diagram of an example golf club head 2000 in accordance with the present disclosure is illustrated. As illustrated, the golf club head 2000 is a driver-type club. In some embodiments, the golf club head 100 may include aspects or elements that are similar or identical to the golf club head 2000 depicted in the schematic. Specifically, the golf club head 2000 includes a front weight center of gravity 2074 similar to the front weight center of gravity 174 of the golf club head 100. Like-reference numbers, as used with respect to the structural features of the golf club head 100, will be used to describe the golf club head 2000 below. As illustrated, the golf club head 2000 includes a face 2012 that extends between a toe 2016 and a heel 2020. A front weight center of gravity 2074 lies within a 38 millimeter region 2090 centered around a club head center of gravity 2088. That is, the front weight center of gravity 2074 is less than or equal to a distance 2094 of 19 millimeters from the club head center of gravity 2088 in a direction substantially parallel to a portion of the face 2012.

Now that various components of a golf club head 100 have been described above, general descriptions of additional embodiments and configurations of golf club heads will be provided below with respect to FIGS. 21-33. In particular, FIGS. 21-28 illustrate additional embodiments of front weight assemblies from an internal perspective of a golf club head. Additionally, FIGS. 29-33 illustrate additional embodiments of front weight assemblies from an external perspective of a golf club head. In general, like-reference numbers, as used with respect to the golf club head 100, will be used where applicable to describe the additional embodiments for clarity and readability.

Figure 21:
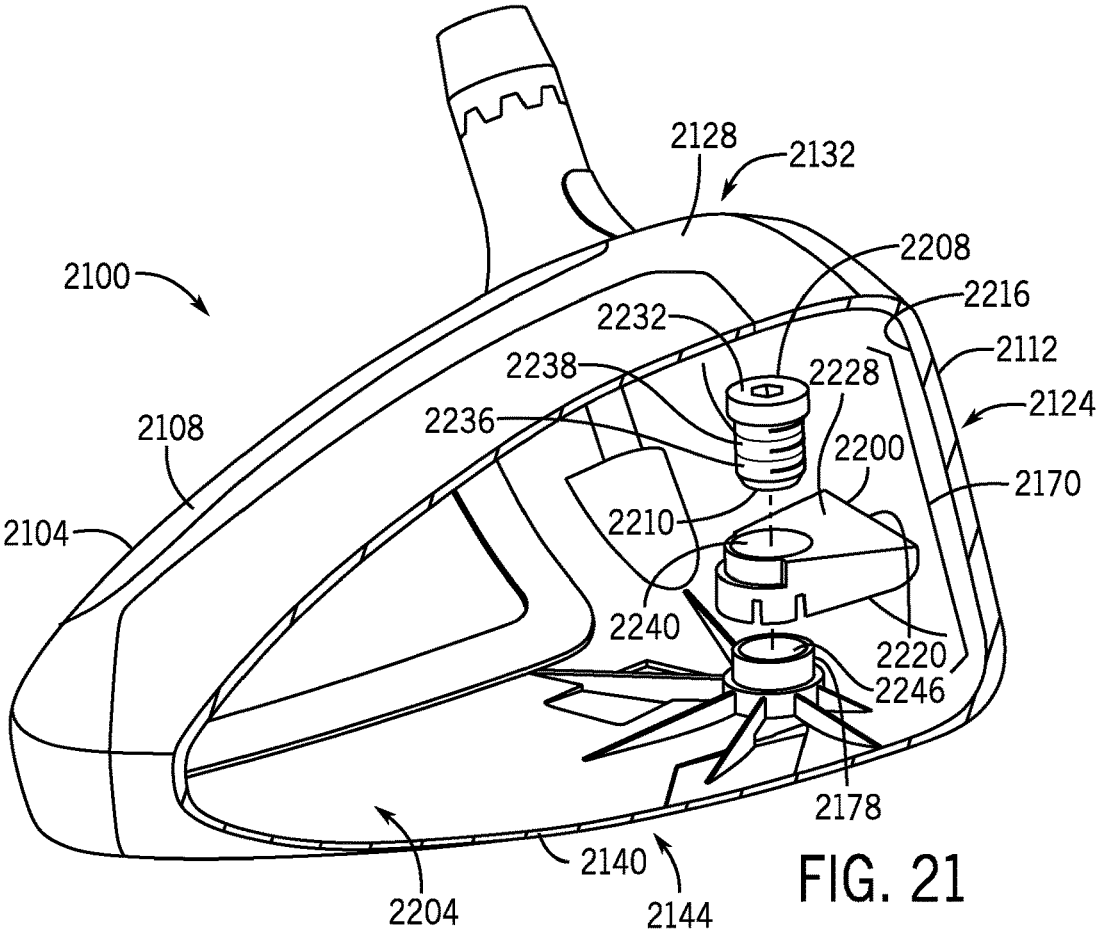
FIG. 21 is rear, left isometric cross-sectional view of a golf club head including an exploded view of another embodiment of a front weight assembly in accordance with the present disclosure.
Figure 22:
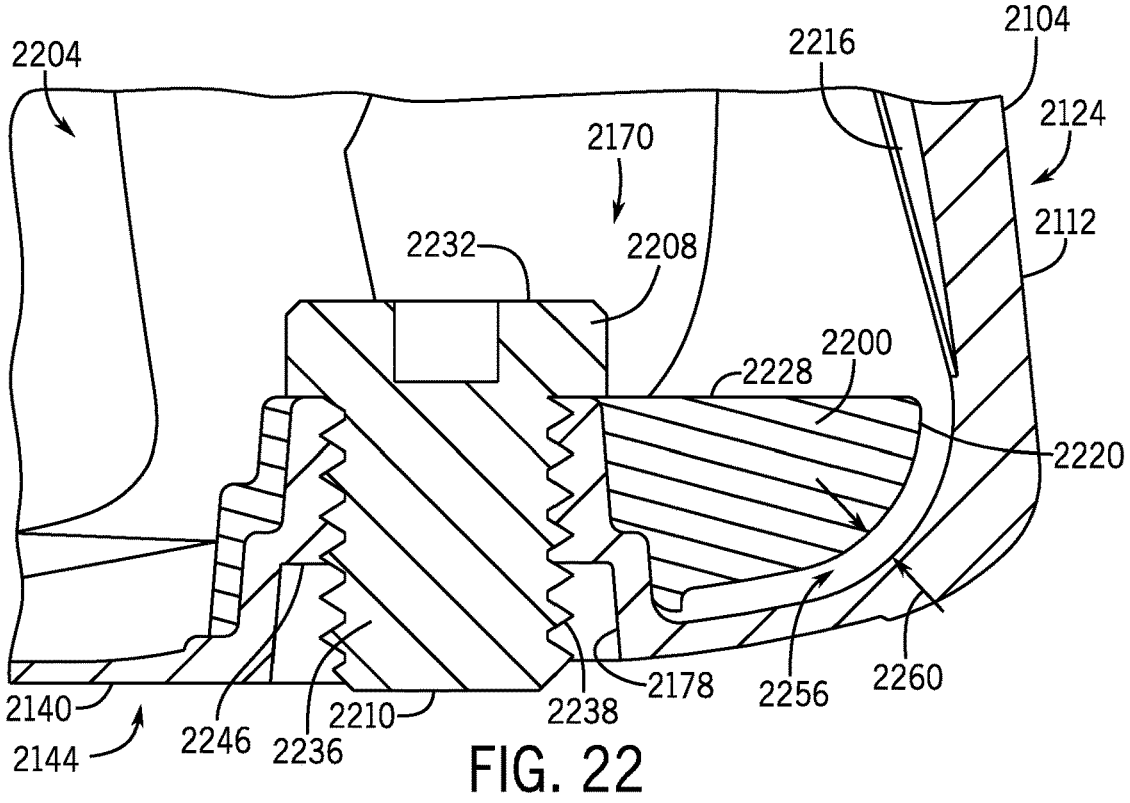
FIG. 22 is a partial left side assembled view of the front weight assembly of FIG. 21.

FIGS. 21 and 22 illustrate an example of a golf club head 2100 according to an embodiment of the disclosure. The golf club head 2100 includes a body 2104 that defines an exterior surface 2108. The body 2104 includes a face 2112 positioned at a forward portion 2124 of the golf club head 2100. The body 2104 further includes a crown 2128 that defines a top portion 2132 of the golf club head 2100 and a sole 2140 that defines a bottom portion 2144 of the golf club head 2100. The golf club head 2100 further includes a front weight assembly 2170 that is partially received by a front weight aperture 2178 formed in the sole 2140.

The front weight assembly 2170 includes a front weight plate 2200 fixed in an interior cavity 2204 defined by the body 2104 and secured by a fastener 2208 adjacent to an interior surface 2216 of the face 2112. The front weight plate 2200 includes a front face 2220 and a top mounting surface 2228. The fastener 2208 includes a head 2232 that is configured to engage the top mounting surface 2228. The fastener 2208 further includes a shaft 2236 that is configured to be received by both a mounting hole 2240 and a cavity mount 2246. The cavity mount 2246 is formed proximate to the front weight aperture 2178 in the interior cavity 2204. In the example shown, the cavity mount 2246 acts as a nut having internal threads (not shown), which can engage external threads 2238 of the shaft 2236. The cavity mount 2246 extends between the exterior surface 2108 and the interior cavity 2204. As such, a distal end 2210 of the fastener 2208 extends outside of the interior cavity 2204 and is substantially flush with the exterior surface 2108. A face gap 2256 is defined between the front face 2220 and the interior surface 2216. In the example shown, the face gap 2256 has a width 2260 of about 5 millimeters; however, other configurations are possible.

Figure 23:
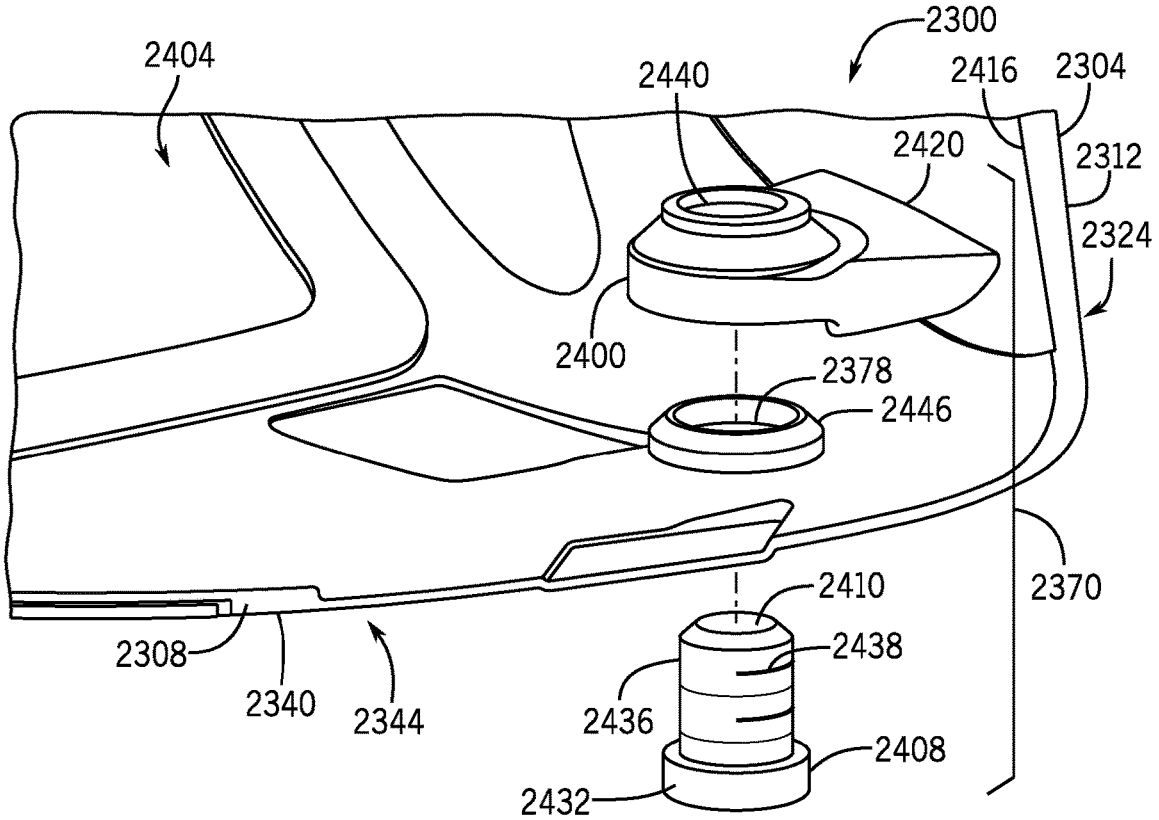
FIG. 23 is a partial rear, left isometric cross-sectional view of a golf club head including an exploded view of another embodiment of a front weight assembly in accordance with the present disclosure.
Figure 24:
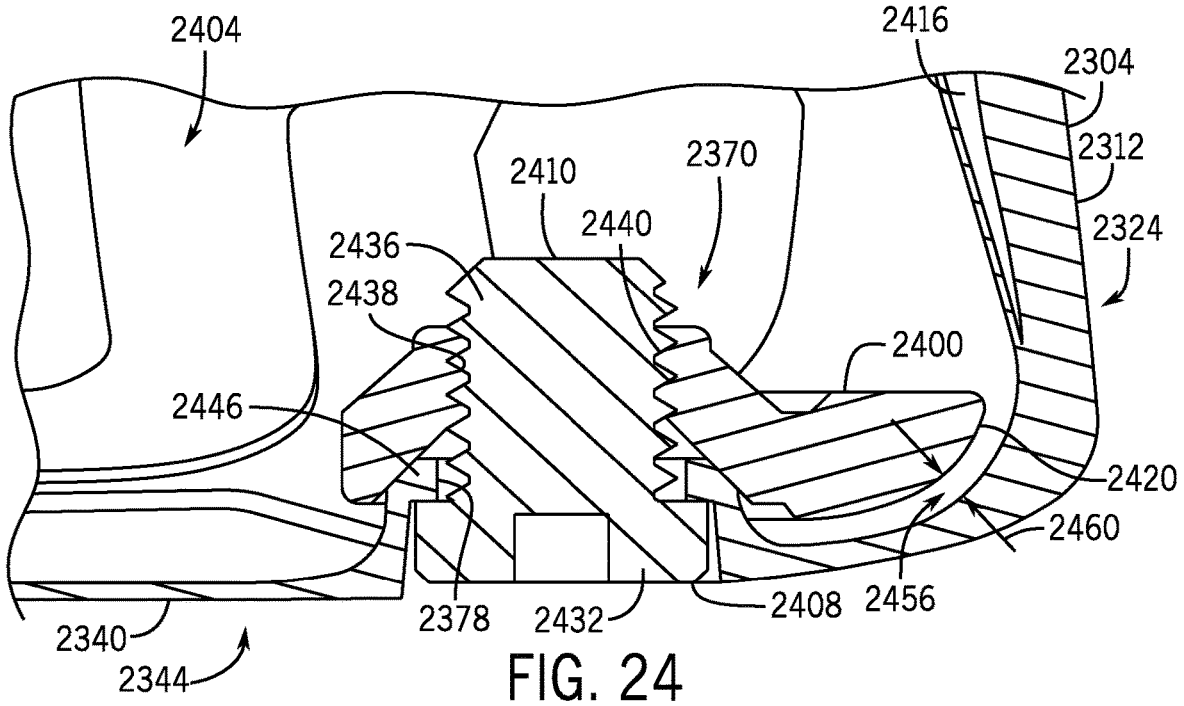
FIG. 24 is a partial left side assembled view of the front weight assembly of FIG. 23.

FIGS. 23 and 24 illustrate an example of a golf club head 2300 according to another embodiment of the disclosure. The golf club head 2300 includes a body 2304 that defines an exterior surface 2308. The body 2304 includes a face 2312 positioned at a forward portion 2324 of the golf club head 2300. The body 2304 further includes a crown (not shown) that defines a top portion of the golf club head 2300 and a sole 2340 that defines a bottom portion 2344 of the golf club head 2300. The golf club head 2300 further includes a front weight assembly 2370 that is received proximate to a front weight aperture 2378 formed in the sole 2340.

The front weight assembly 2370 includes a front weight plate 2400, including a front face 2420, fixed in an interior cavity 2404 defined by the body 2304 and secured by a fastener 2408 adjacent to an interior surface 2416 of the face 2312. The fastener 2408 includes a head 2432 configured to engage a mounting surface (not shown) proximate to the front weight aperture 2378. The fastener 2408 further includes a shaft 2436 configured to be received by both a mounting hole 2440 and a cavity mount 2446. The cavity mount 2446 is formed proximate to the front weight aperture 2378 in the interior cavity 2404. In the example shown, the mounting hole 2440 acts as a nut having internal threads (not shown) which can engage external threads 2438 of the shaft 2436. As such, a distal end 2410 of the fastener 2408 extends into the interior cavity 2404 and the head 2432 is substantially flush with the exterior surface 2308. A face gap 2456 is defined between the front face 2420 and the interior surface 2416. In the example shown, the face gap 2456 has a width 2460 of about 5 millimeters; however, other configurations are possible.

Figure 25:
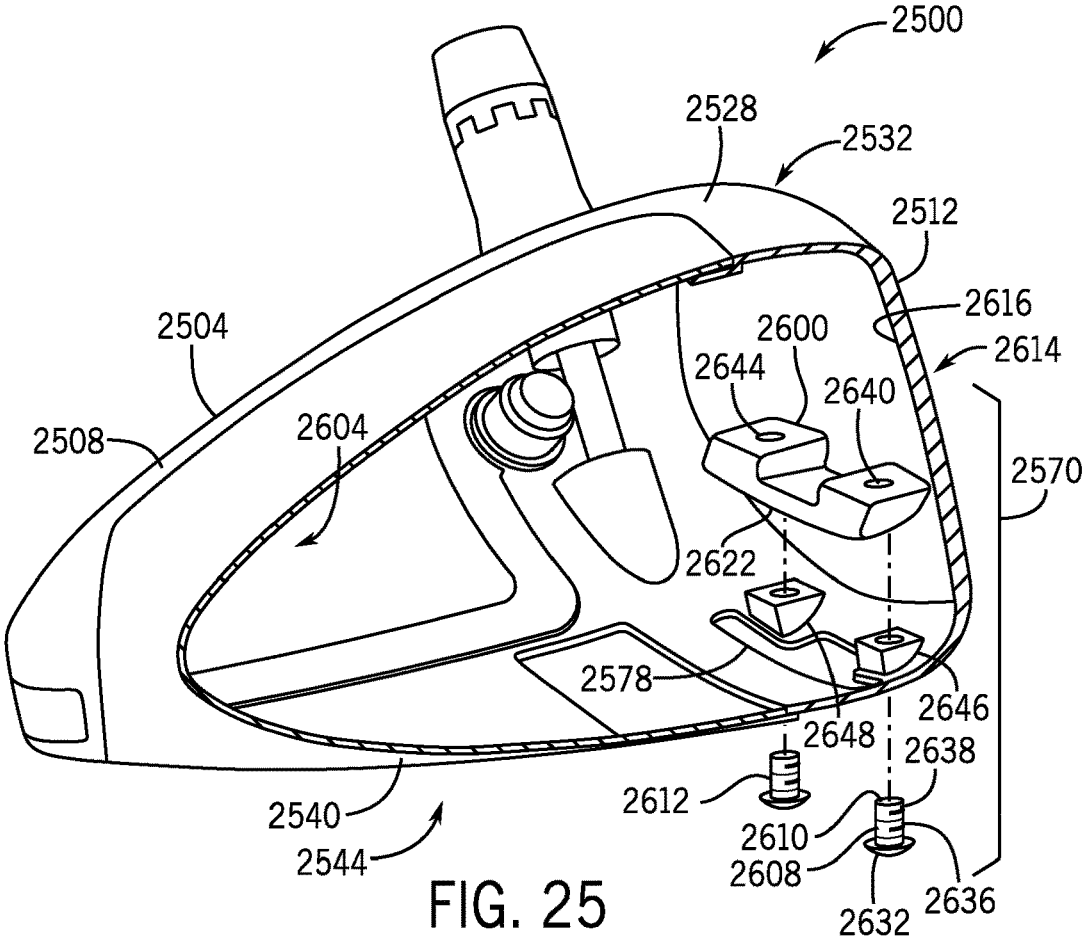
FIG. 25 is a rear, left isometric cross-sectional view of a golf club head including an exploded view of another embodiments of a front weight assembly in accordance with aspects of the present disclosure.
Figure 26:
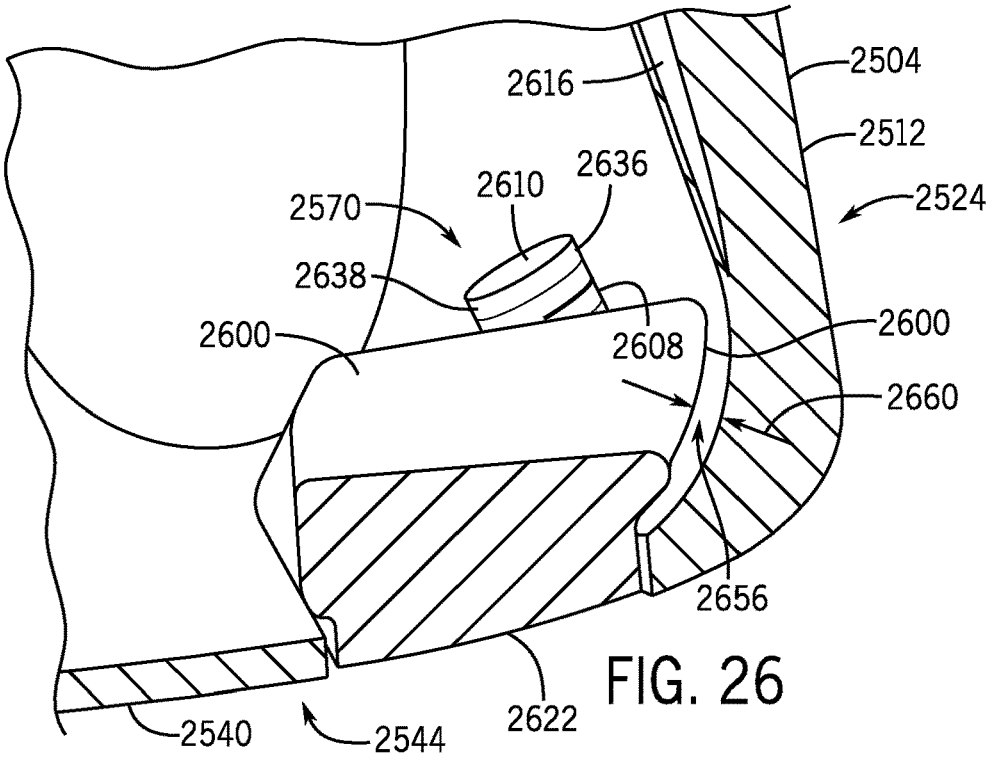
FIG. 26 is a partial left side assembled view of the front weight assembly of FIG. 25.

FIGS. 25 and 26 illustrate an example of a golf club head 2500 according to an embodiment of the disclosure. The golf club head 2500 includes a body 2504 that defines an exterior surface 2508. The body 2504 includes a face 2512 that is positioned at a forward portion 2524 of the golf club head 2500. The body 2504 further includes a crown 2528 that defines a top portion 2532 of the golf club head 2500 and a sole 2540 that defines a bottom portion 2544 of the golf club head 2500. The golf club head 2500 further includes a front weight assembly 2570 and a front weight aperture 2578 formed in the sole 2540.

The front weight assembly 2570 includes a front weight plate 2600 fixed in an interior cavity 2604 defined by the body 2504 and secured by first and second fasteners 2608, 2612 adjacent to an interior surface 2616 of the face 2512. The weight plate 2600 includes a front face 2620 and a bottom surface 2622. Each of the first and second fasteners 2608, 2612 include a head 2632 configured to engage a mounting surface (not shown) proximate to the front weight aperture 2578 and a shaft 2636 configured to be received by each mounting hole 2640, 2644 and each cavity mount 2646, 2648, respectively. Each cavity mount 2646, 2648 is formed proximate the front weight aperture 2578 in the interior cavity 2604. In the example shown, the mounting holes 2640, 2644 act as nuts having internal threads (not shown), which can engage external threads 2638 of the shaft 2636. As such, a distal end 2610 of each fastener 2608, 2612 extends into the interior cavity 2604 and the head 2632 and the bottom surface 2622 are substantially flush with the exterior surface 2508. A face gap 2656 is defined between the front face 2620 and the interior surface 2616. In the example shown, the face gap 2656 has a width 2660 of about 5 millimeters; however, other configurations are possible.

Figure 27:
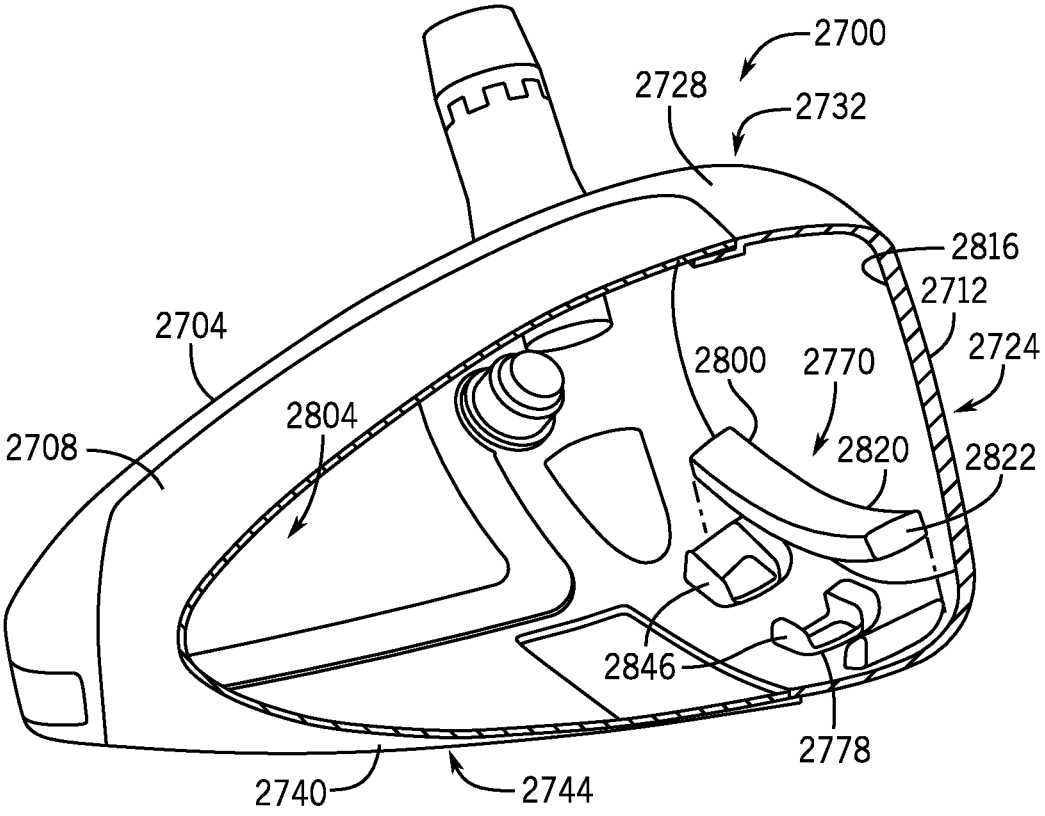
FIG. 27 is a rear left isometric cross-sectional view of a golf club head including an exploded view of another embodiment of a front weight assembly in accordance with the present disclosure.
Figure 28:
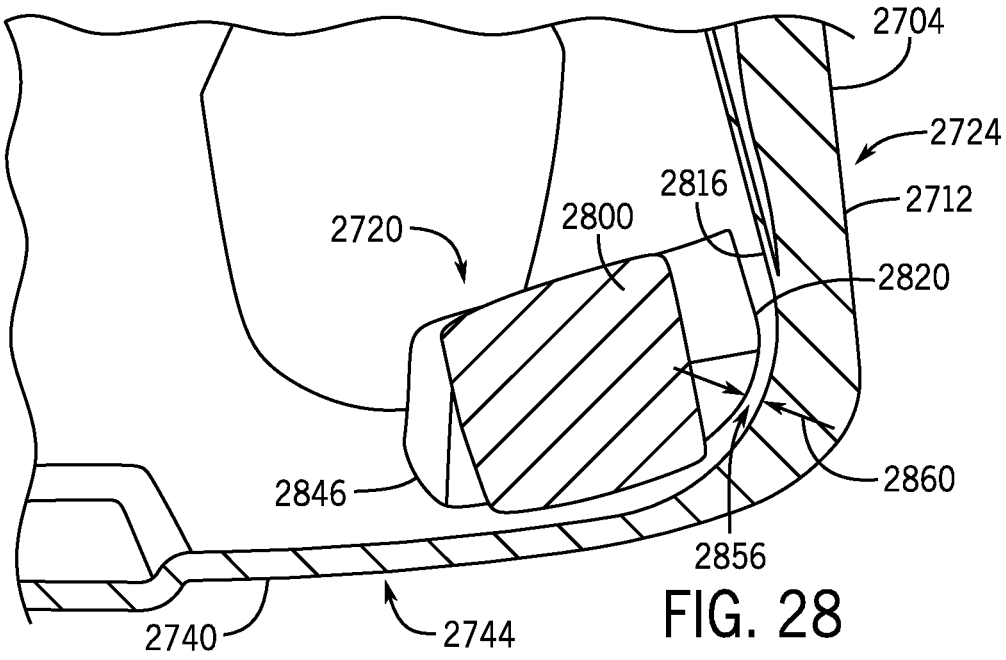
FIG. 28 is a partial left side assembled view of the front weight assembly of FIG. 27.

FIGS. 27 and 28 illustrate an example of a golf club head 2700 according to an embodiment of the disclosure. The golf club head 2700 includes a body 2704 that defines an exterior surface 2708. The body 2704 includes a face 2712 positioned at a forward portion 2724 of the golf club head 2700. The body 2704 further includes a crown 2728 that defines a top portion 2732 of the golf club head 2700 and a sole 2740 that defines a bottom portion 2744 of the golf club head 2700. The golf club head 2700 further includes a front weight assembly 2770 that is at least partially received by a front weight aperture 2778 formed in the sole 2740.

The front weight assembly 2770 includes a front weight plate 2800 fixed in an interior cavity 2804 defined by the body 2704 and secured adjacent to an interior surface 2816 of the face 2712. The weight plate 2800 includes a front face 2820 and lateral sides 2822. The weight plate 2800 is dimensioned to engage cavity mounts 2846 thereby creating an interference fit. A face gap 2856 is defined between the front face 2820 and the interior surface 2816. In the example shown, the face gap 2856 has a width 2860 of about 5 millimeters; however, other configurations are possible.

Figure 29:
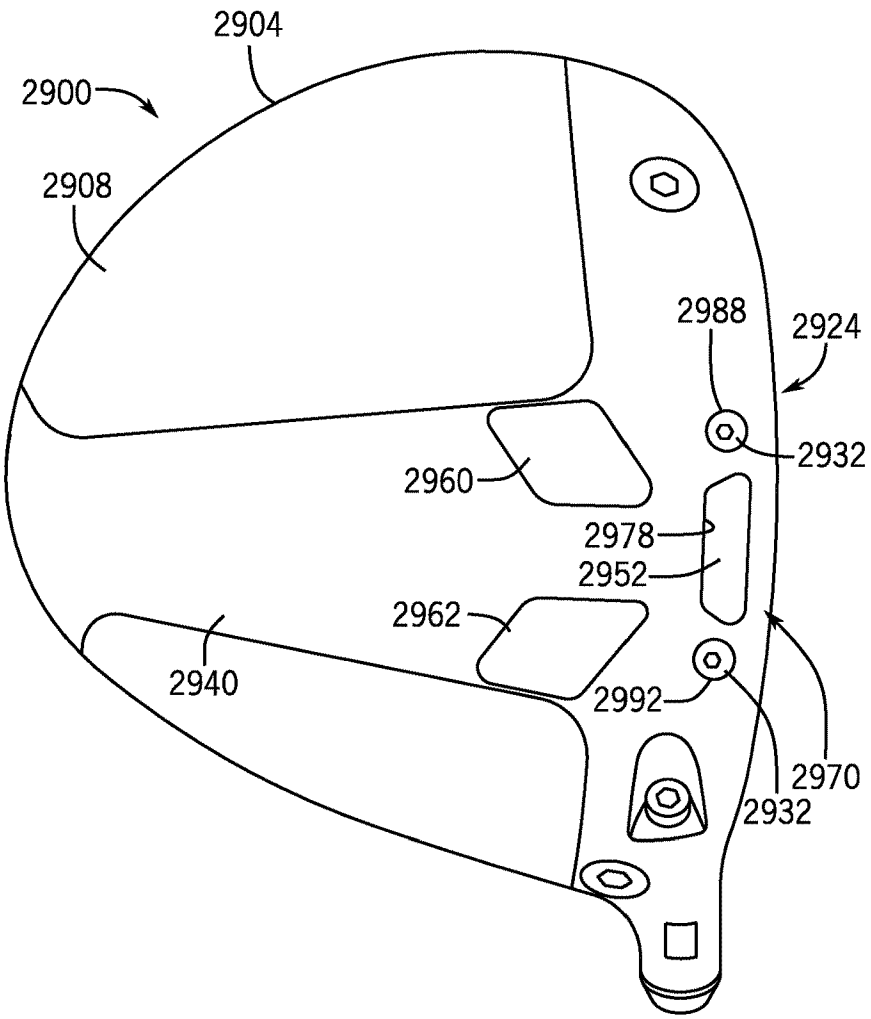
FIG. 29 is a bottom view of another embodiment of a golf club head in accordance with the present disclosure.

FIG. 29 illustrates an example of a golf club head 2900 according to an embodiment of the disclosure. The golf club head 2900 includes a body 2904 that defines an exterior surface 2908. The body 2904 includes a face (not shown) positioned at a forward portion 2924 of the golf club head 2900. The golf club head 2900 further includes a front weight assembly 2970 that is at least partially received by a front weight aperture 2978 formed in a sole 2940 of the body 2904 proximate to the face. The exterior surface 2908 includes first and second indicators 2960, 2962 that allow a player to visually acknowledge the presence of the front weight assembly 2970. In the example shown, the first and second indicators 2960, 2962 are configured as raised surfaces; however, other configurations are possible. For example, color may be used to provide a visual indication of a front weight assembly.

A front weight plate (not shown) is fixed in an interior cavity defined by the body 2904 and secured by first and second fasteners 2988, 2992. Each of the first and second fasteners 2988, 2992 include a distal end 2932 received in cavity mounts (not shown) proximate to the front weight aperture 2978, respectively. The distal ends 2932 are substantially flush with the exterior surface 2908. The front weight assembly 2970 further includes a sole mount 2952 that is dimensioned to be received in the front weight aperture 2978.

Figure 30:
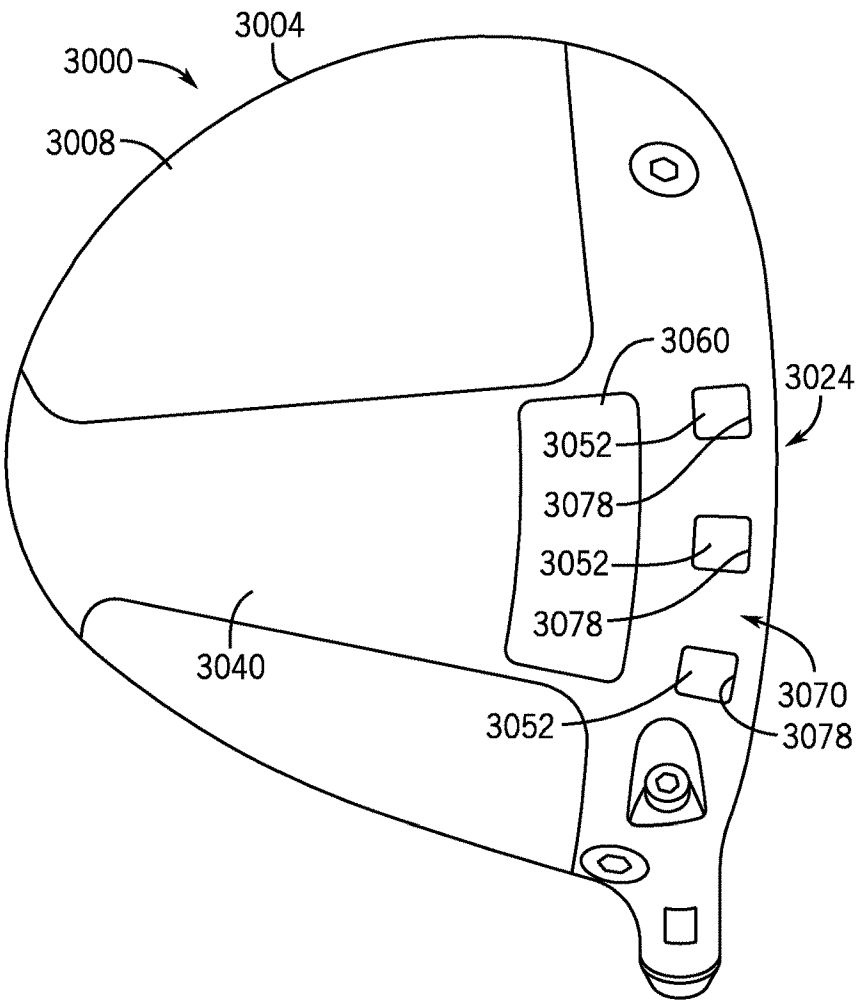
FIG. 30 is a bottom view of a different embodiment of a golf club head in accordance with the present disclosure.

FIG. 30 illustrates an example of a golf club head 3000 according to an embodiment of the disclosure. The golf club head 3000 includes a body 3004 that defines an exterior surface 3008. The body 3004 includes a face (not shown) positioned at a forward portion 3024 of the golf club head 3000. The golf club head 3000 further includes a front weight assembly 3070 that is at least partially received by a front weight aperture 3078 formed in a sole 3040 of the body 3004 proximate to the face. The exterior surface 3008 includes an indicator 3060 that allows a player to visually acknowledge the presence of the front weight assembly 3070. In the example shown, the indicator 3060 is configured as a raised surface. A front weight plate (not shown) is fixed in an interior cavity defined by the body 3004 and secured by a fastener (not shown). The front weight assembly 3070 further includes a sole mount 3052 that is dimensioned to be received in the front weight aperture 3078.

Figure 31:
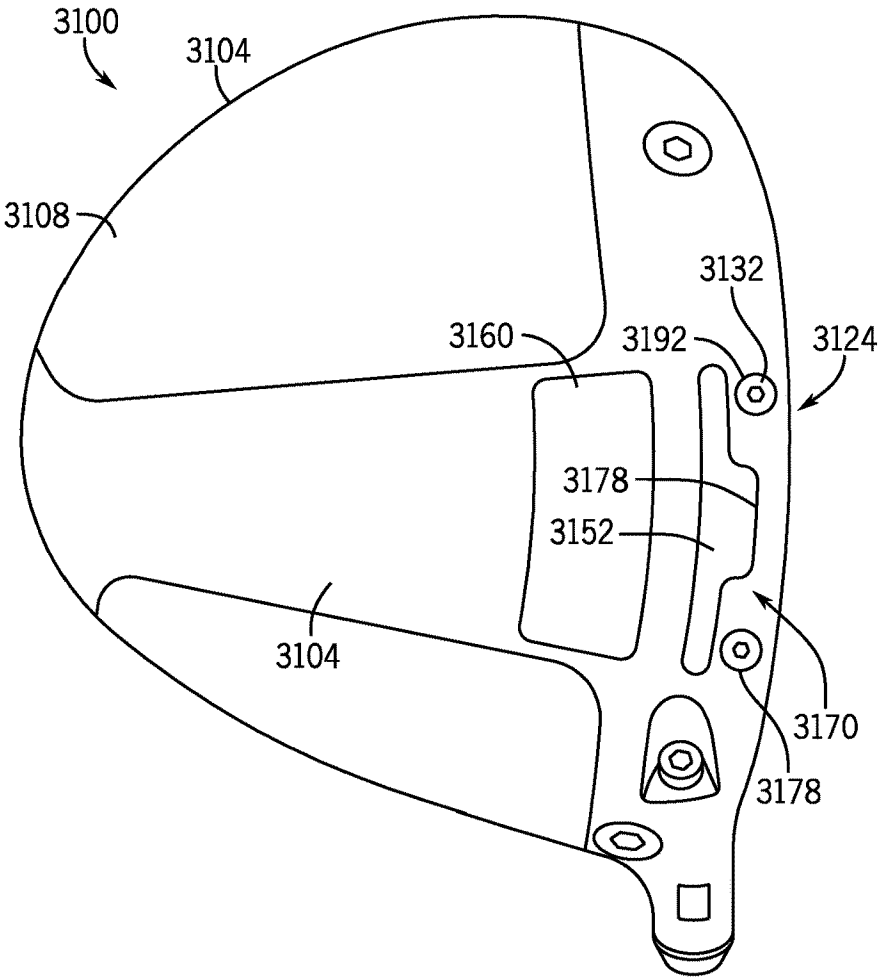
FIG. 31 is a bottom view of yet another embodiment of a golf club head in accordance with the present disclosure.

FIG. 31 illustrates an example of a golf club head 3100 according to an embodiment of the disclosure. The golf club head 3100 includes a body 3104 that defines an exterior surface 3108 and includes a face (not shown) positioned at a forward portion 3124 of the golf club head 3100. The golf club head 3100 further includes a front weight assembly 3170 that is at least partially received by a front weight aperture 3178 formed in a sole 3140 of the body 3104 proximate to the face. The exterior surface 3108 includes an indicator 3160 that allows a player to visually acknowledge the presence of the front weight assembly 3170. In the example shown, the indicator 3160 is configured as a raised surface. A front weight plate (not shown) is fixed in an interior cavity defined by the body 3104 and secured by first and second fasteners 3188, 3192. Each of the first and second fasteners 3188, 3192 include a head 3132 received in a recessed portion (not shown) proximate to the front weight aperture 3178. The front weight assembly 3170 further includes a sole mount 3152 that is dimensioned to be received in the front weight aperture 3178 and is substantially flush with the exterior surface 3108.

Figure 32:
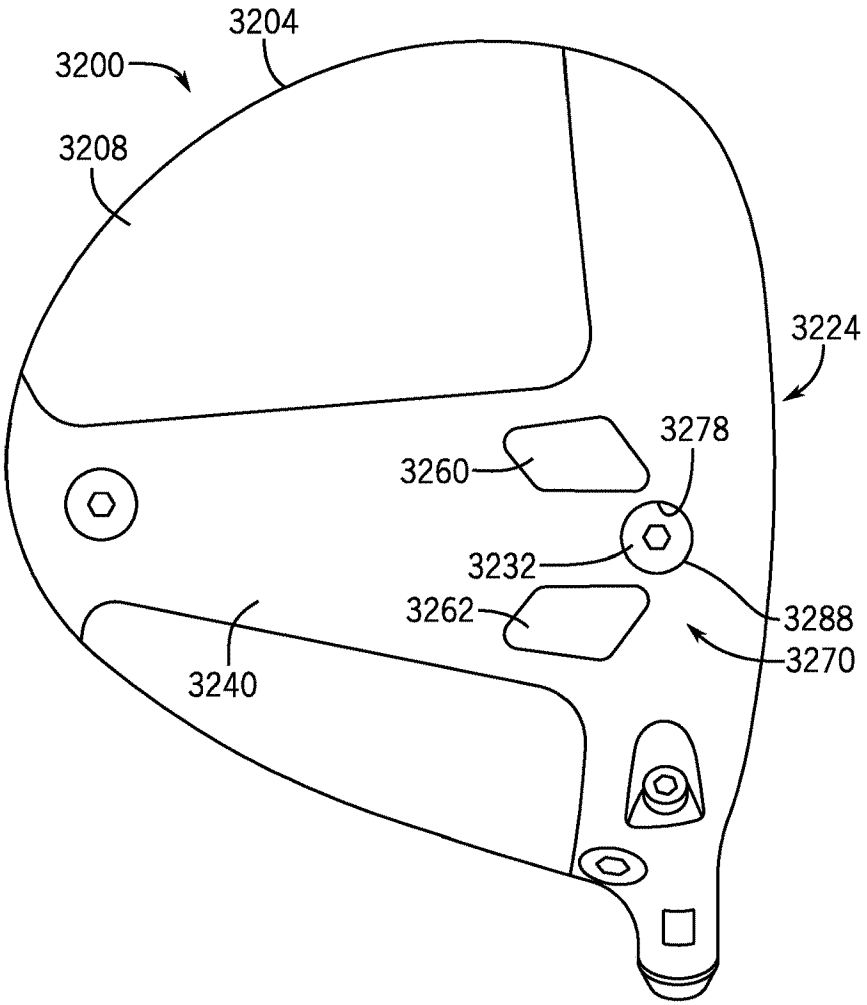
FIG. 32 is a bottom view of another embodiment of a golf club head in accordance with the present disclosure.

FIG. 32 illustrates an example of a golf club head 3200 according to an embodiment of the disclosure. The golf club head 3200 includes a body 3204 that defines an exterior surface 3208 and includes a face (not shown) positioned at a forward portion 3224 of the golf club head 3200. The golf club head 3200 further includes a front weight assembly 3270 that is at least partially received by a front weight aperture 3278 formed in a sole 3240 of the body 3204 proximate to the face (not shown). The exterior surface 3208 includes first and second indicators 3260, 3262 that allow a player to visually acknowledge the presence of the front weight assembly 3270. In the example shown, the first and second indicators 3260, 3262 are configured as raised surfaces. A front weight plate (not shown) is fixed in an interior cavity defined by the body 3204 and secured by a fastener 3288. The fastener 3288 includes a head 3232 received proximate to a recessed portion (not shown) of the front weight aperture 3278.

Figure 33:
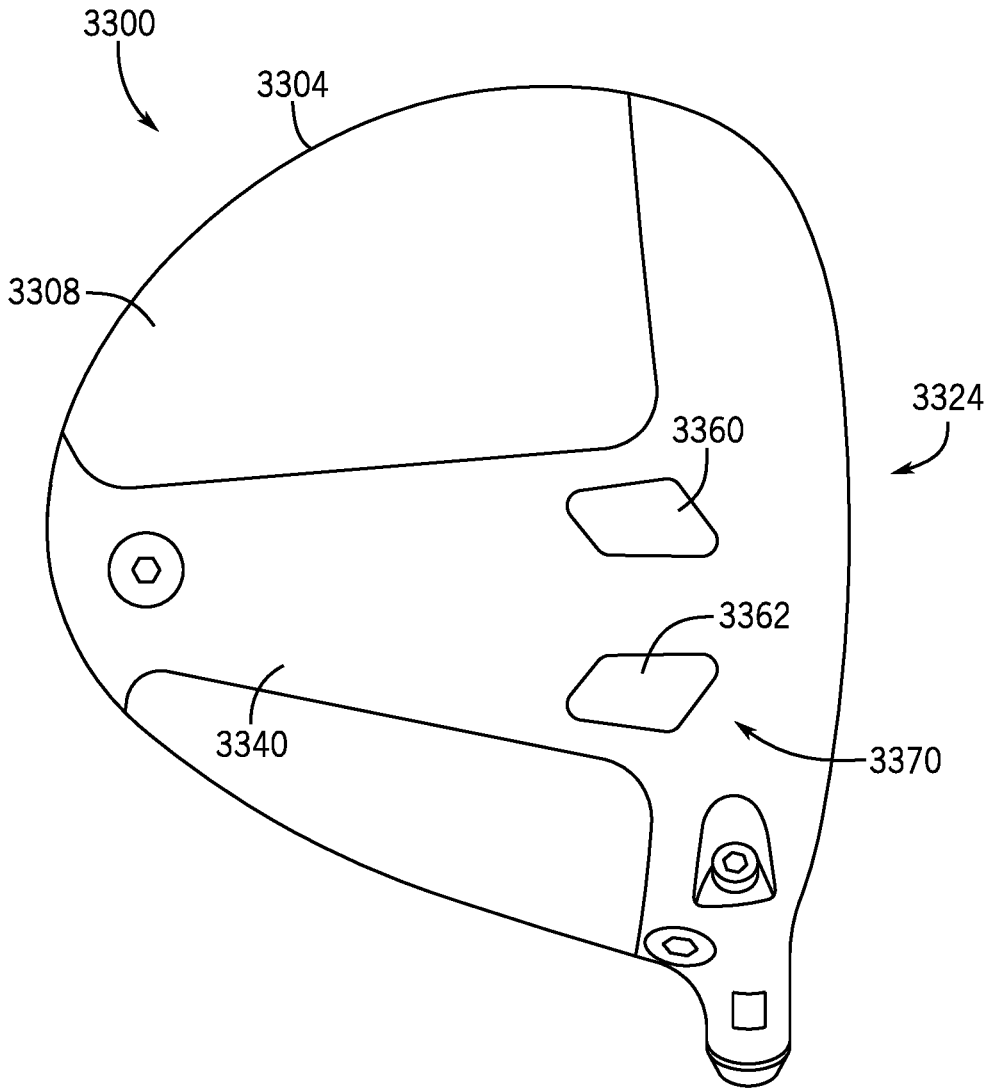
FIG. 33 is a bottom view of still another embodiment of a golf club head in accordance with the present disclosure.

FIG. 33 illustrates an example of a golf club head 3300 according to an embodiment of the disclosure. The golf club head 3300 includes a body 3304 that defines an exterior surface 3308 and includes a face (not shown) positioned at a forward portion 3324 of the golf club head 3300. The golf club head 3300 further includes a front weight assembly (not shown) proximate to the face. A sole 3340 of the exterior surface 3308 includes first and second indicators 3360, 3362 that allow a player to visually acknowledge the presence of the front weight assembly 3370. In the example shown, the first and second indicators 3360, 3362 are configured as raised surfaces.

Any of the embodiments described herein may be modified to include any of the structures or methodologies disclosed in connection with different embodiments. Further, the present disclosure is not limited to golf clubs of the type specifically shown. Still further, aspects of the golf club heads and weighting systems of any of the embodiments disclosed herein may be modified to work with any type of golf club.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the disclosure are set forth in the following claims.

INDUSTRIAL APPLICABILITY

Numerous modifications to the present disclosure will be apparent to those skilled in the art in view of the foregoing description. Accordingly, this description is to be construed as illustrative only and is presented for the purpose of enabling those skilled in the art to make and use the same. The exclusive rights to all modifications which come within the scope of the appended claims are reserved.

We claim:

1. A golf club head defining a head center of gravity, the golf club head comprising:

a body defining an interior cavity and an exterior surface having a forward-most point and a rearward-most point that define a horizontal club head length therebetween that extends parallel to a ground plane, the body comprising:

a face disposed within a forward portion of the golf club head and extending between a toe and a heel;

a sole defining a bottom portion of the golf club head; and a crown defining a top portion of the golf club head;

a front weight assembly having a first weight secured with at least one fastener to the sole, the front weight assembly being disposed forward of the head center of gravity and between the toe and the heel, the front weight assembly defining a first center of gravity; and a rear weight assembly having a second weight that is coupled with the body, the rear weight assembly being disposed rearward of the head center of gravity, and defining a second center of gravity, the crown being devoid of a weight, wherein a sole gap is formed between an underside of the first weight and the sole, the sole gap defining a height of between 0.5 millimeters and 6 millimeters, wherein the first center of gravity and the second center of gravity define a horizontal weight system length therebetween that extends parallel to the ground plane, and wherein a ratio between the horizontal weight system length and the horizontal club head length expressed as a percentage is between 80% and 99%.

2. The golf club head of claim 1, wherein the at least one fastener defines an axis that extends through the sole and the crown.

3. The golf club head of claim 1, wherein the first weight is secured with at least two fasteners that extend toward the sole.

4. The golf club head of claim 3, wherein the at least two fasteners define axes that extend through the crown and the sole.

5. The golf club head of claim 1, wherein the second weight is disposed exterior to the body, and the first weight is disposed interior to the body.

6. The golf club head of claim 1, wherein the ratio between the horizontal weight system length and the horizontal club head length expressed as a percentage is between 85.8% and 99%.

7. The golf club head of claim 1, wherein a front weight aperture is provided forward of the head center of gravity, the front weight aperture being configured to receive one of the at least one fasteners.

8. The golf club head of claim 1, wherein the front weight assembly further includes a sole mount that is dimensioned to be received in a front weight aperture, the sole mount being coupled to and disposed along an underside of the sole.

9. The golf club head of claim 8, wherein the sole mount is configured to be removable from the golf club head.

10. The golf club head of claim 1, wherein the second weight of the rear weight assembly is not secured using a fastener.

11. A golf club head defining a head center of gravity, the golf club head comprising:

a body defining an interior cavity and an exterior surface having a forward-most point and a rearward-most point that define a horizontal club head length therebetween that extends parallel to a ground plane, the body comprising:

a face disposed within a forward portion of the golf club head and extending between a toe and a heel;

a sole defining a bottom portion of the golf club head; and a crown defining a top portion of the golf club head;

a front weight assembly having a first weight secured, the front weight assembly being disposed forward of the head center of gravity and between the toe and the heel, the front weight assembly defining a first center of gravity; and a rear weight assembly having a second weight that is coupled with the body, the rear weight assembly being disposed rearward of the head center of gravity, and defining a second center of gravity, the crown being devoid of a weight, wherein the front weight assembly is coupled with the sole, wherein the first center of gravity and the second center of gravity define a horizontal weight system length therebetween that extends parallel to the ground plane, and wherein a ratio between the horizontal weight system length and the horizontal club head length expressed as a percentage is between 80% and 99%.

12. The golf club head of claim 11, wherein a sole gap is formed between an underside of the first weight and the sole, the sole gap defining a height of between 0.5 millimeters and 6 millimeters.

13. The golf club head of claim 11, wherein the first weight is secured with at least one fastener that extends toward the sole.

14. The golf club head of claim 11, wherein the ratio between the horizontal weight system length and the horizontal club head length is between 81.9% and 99%.

15. The golf club head of claim 11, wherein a front weight aperture is provided forward of the head center of gravity, the front weight aperture being configured to receive at least one fastener.

16. The golf club head of claim 15, wherein the front weight assembly further includes a sole mount that is dimensioned to be received in the front weight aperture, the sole mount being coupled to and disposed along an underside of the sole.

17. A golf club head defining a head center of gravity, the golf club head comprising:

a body defining an exterior surface having a forward-most point and a rearward-most point that define a horizontal club head length therebetween that extends parallel to a ground plane, the body comprising:

a face disposed within a forward portion of the golf club head and extending between a toe and a heel;

a sole defining a bottom portion of the golf club head; and a crown defining a top portion of the golf club head;

a front weight assembly having a first weight, the front weight assembly being disposed forward of the head center of gravity and between the toe and the heel, the front weight assembly defining a first center of gravity; and a rear weight assembly having a second weight that is coupled with the body, the rear weight assembly being disposed rearward of the head center of gravity, and defining a second center of gravity, the crown being devoid of a weight, wherein the front weight assembly is secured to the sole, wherein a sole gap is formed between an underside of the first weight and the sole, the sole gap defining a height of between 1 millimeter and 6 millimeters, wherein the first center of gravity and the second center of gravity define a horizontal weight system length therebetween that extends parallel to the ground plane, and wherein a ratio between the horizontal weight system length and the horizontal club head length expressed as a percentage is between 80% and 99%.

18. The golf club head of claim 17, wherein the first weight is secured to the front weight assembly with at least one fastener that defines an axis extending through the sole and the crown.

19. The golf club head of claim 17, wherein a face gap is formed between a side of the first weight and the face, the face gap defining a width of between 1 millimeter and 4 millimeters.

20. The golf club head of claim 17, wherein at least one of the front weight assembly and the rear weight assembly is adjustable.

* * * * *